US011328656B2

(12) United States Patent
Yang et al.

(10) Patent No.: US 11,328,656 B2
(45) Date of Patent: May 10, 2022

(54) PIXEL DRIVING CIRCUIT, PIXEL DRIVING METHOD AND DISPLAY DEVICE

(71) Applicant: BOE TECHNOLOGY GROUP CO., LTD., Beijing (CN)

(72) Inventors: Shengji Yang, Beijing (CN); Xiaochuan Chen, Beijing (CN); Hui Wang, Beijing (CN); Pengcheng Lu, Beijing (CN); Kuanta Huang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/059,922

(22) PCT Filed: Apr. 16, 2020

(86) PCT No.: PCT/CN2020/085172
§ 371 (c)(1),
(2) Date: Nov. 30, 2020

(87) PCT Pub. No.: WO2020/216128
PCT Pub. Date: Oct. 29, 2020

(65) Prior Publication Data

US 2021/0174736 A1 Jun. 10, 2021

(30) Foreign Application Priority Data

Apr. 25, 2019 (CN) ..... 201910339734.5

(51) Int. Cl.
*G09G 3/32* (2016.01)

(52) U.S. Cl.
CPC ..... *G09G 3/32* (2013.01); *G09G 2300/0426* (2013.01); *G09G 2310/027* (2013.01); *G09G 2310/0278* (2013.01)

(58) Field of Classification Search
CPC ..... G09G 2310/027; G09G 2300/0426; G09G 2310/0278; G09G 3/32
See application file for complete search history.

(56) References Cited

U.S. PATENT DOCUMENTS 10,923,031 B2 * 2/2021 Yang ..... G09G 3/3258
2008/0024526 A1 1/2008 Ko et al.
(Continued)

FOREIGN PATENT DOCUMENTS

CN 103700342 A 4/2014
CN 105096838 A 11/2015
(Continued)

OTHER PUBLICATIONS

Office Action dated Apr. 29, 2020 in Chinese Application No. 201910339734.5, 12 pages.

*Primary Examiner* — Muhammad N Edun
(74) *Attorney, Agent, or Firm* — Muncy, Geissler, Olds & Lowe, P.C.

(57) ABSTRACT

A pixel driving circuit, a pixel driving method and a display device are provided. the pixel driving circuit includes a driving circuit and a light-emitting duration control circuit, a first end of the driving circuit is connected to a first voltage end, a second end of the driving circuit is connected to the light-emitting element, and the driving circuit is configured to control the first end and the second end to connect to each other; the light-emitting duration control circuit is configured to switch on or switch off a connection between the second end of the driving circuit and the light-emitting element, according to a control data voltage input by a control data line and a control initial voltage input by a control initial voltage end.

19 Claims, 9 Drawing Sheets

(56) References Cited

U.S. PATENT DOCUMENTS

| | | | | |
|---|---|---|---|---|
| 2009/0207158 | A1 | 8/2009 | Park et al. | |
| 2011/0164025 | A1* | 7/2011 | Saito | H01L 51/001 345/212 |
| 2016/0035276 | A1 | 2/2016 | Yin et al. | |
| 2017/0193908 | A1* | 7/2017 | Wang | G09G 3/3233 |
| 2017/0263180 | A1 | 9/2017 | Zhu | |
| 2018/0047337 | A1* | 2/2018 | Zhu | G09G 3/3233 |
| 2018/0218674 | A1* | 8/2018 | Ma | G09G 3/3266 |

FOREIGN PATENT DOCUMENTS

| | | | |
|---|---|---|---|
| CN | 107909966 | A | 4/2018 |
| CN | 108320703 | A | 7/2018 |
| CN | 108470537 | A | 8/2018 |
| CN | 109493796 | A | 3/2019 |
| CN | 110010057 | A | 7/2019 |

* cited by examiner

PIXEL DRIVING CIRCUIT, PIXEL DRIVING METHOD AND DISPLAY DEVICE

CROSS REFERENCE OF RELATED APPLICATIONS

The present application is the U.S. national phase of PCT Application PCT/CN2020/085172 filed on Apr. 16, 2020, which claims a priority of Chinese patent application No. 201910339734.5 filed on Apr. 25, 2019, which are incorporated herein by reference in their entirety.

TECHNICAL FIELD

The present disclosure relates to the field of display technologies, and in particular, to a pixel driving circuit, a pixel driving method and a display device.

BACKGROUND

Compared with an Organic Light-emitting Diode (OLED), the Micro LED has higher efficiency, lower power consumption and higher reliability, and is likely to become a novel display product in the future. In the related art, the Micro LED is mostly formed on a substrate with a driving circuit by using a transfer printing technology, and the driving circuit drives the Micro LED to emit light and display.

Micro LEDs decrease in efficiency at low current densities as the current density decreases. If the current density is used to modulate gray levels, the low gray levels will correspond to low current densities and the efficiency will be decreased. Moreover, with the change of the current density, the color coordinate of the Micro LED changes, that is, a color shift may occur in the Micro LED display when the gray level changes.

When a pixel driving circuit adopting a Micro LED in the related art works, the output characteristic of the Micro LED under a low gray level cannot be ensured, and meanwhile, a color shift may occur when the gray level changes.

SUMMARY

A pixel driving circuit is provided in the present disclosure, applied to drive a light-emitting element, where the pixel driving circuit includes a driving circuit and a light-emitting duration control circuit, a first end of the driving circuit is connected to a first voltage end, a second end of the driving circuit is connected to the light-emitting element via the light-emitting duration control circuit, and the driving circuit is configured to, under a control of a voltage of a control end of the driving circuit, control the first end and the second end to connect to each other;

the light-emitting duration control circuit is configured to, in response to a first reset signal input by a first reset end and a control scanning signal input by a control scanning line, switch on or switch off a connection between the second end of the driving circuit and the light-emitting element, according to a control data voltage input by a control data line and a control initial voltage input by a control initial voltage end, to control a light-emitting period of the light-emitting element.

Optionally, the light-emitting duration control circuit includes a driving control sub-circuit, a driving control reset sub-circuit and a switching-on control sub-circuit, where a first end of the driving control sub-circuit is connected to the second end of the driving circuit, and a second end of the driving control sub-circuit is connected to the light-emitting element;

the driving control reset sub-circuit is configured to, in response to the first reset signal input by the first reset end, write the control initial voltage into a control end of the driving control sub-circuit, to enable the driving control sub-circuit to switch off the connection between the second end of the driving circuit and the light-emitting element under a control of a voltage of the control end of the driving control sub-circuit;

the switching-on control sub-circuit is configured to, in response to the control scanning signal, charge the control end of the driving control sub-circuit with the control data voltage, to enable the driving control sub-circuit to switch on the connection between the second end of the driving circuit and the light-emitting element under a control of a voltage of the control end of the driving control sub-circuit.

Optionally, the switching-on control sub-circuit includes a first switching-on control transistor, a second switching-on control transistor and a switching-on control capacitor;

a control electrode of the first switching-on control transistor is connected to the control end of the driving control sub-circuit, a first electrode of the first switching-on control transistor is connected to a first electrode of the second switching-on control transistor, and a second electrode of the first switching-on control transistor is connected to the control data line;

a control electrode of the second switching-on control transistor is connected to the control scanning line, and a second electrode of the second switching-on control transistor is connected to the control end of the driving control sub-circuit; and a first end of the switching-on control capacitor is connected to the control end of the driving control sub-circuit, and a second end of the switching-on control capacitor is connected to a second voltage end.

Optionally, the driving control reset sub-circuit includes a driving control reset transistor;

a control electrode of the driving control reset transistor is connected to the first reset end, a first electrode of the driving control reset transistor is connected to the control end of the driving control sub-circuit, and a second electrode of the driving control reset transistor is connected to the control initial voltage end; the control initial voltage end is configured to input the control initial voltage.

Optionally, the driving control sub-circuit includes a driving control transistor;

a control electrode of the driving control transistor is the control end of the driving control sub-circuit, a first electrode of the driving control transistor is the first end of the driving control sub-circuit, and a second electrode of the driving control transistor is the second end of the driving control sub-circuit.

Optionally, the pixel driving circuit further includes a reset circuit, where the reset circuit is configured to, in response to a second reset signal input by a second reset end, write a display initial voltage into the control end of the driving circuit, to enable the driving circuit to control the first end and the second end of the driving circuit to connect to each other under the control of the voltage of the control end of the driving circuit.

Optionally, the pixel driving circuit further includes a voltage maintaining circuit and a data writing circuit;

the voltage maintaining circuit is connected to the control end of the driving circuit and configured to maintain a voltage of the control end of the driving circuit;

the data writing circuit is configured to, in response to a display scanning signal input by a display scanning line, control the voltage of the control end of the driving circuit according to a display data voltage input by a display data line.

Optionally, the data writing circuit includes a data writing sub-circuit and a compensation control sub-circuit, where the data writing sub-circuit is configured to, in response to the display scanning signal, write the display data voltage into the first end of the driving circuit;

the compensation control sub-circuit is configured to, in response to the display scanning signal, control the control end of the driving circuit and the second end of the driving circuit to connect to each other.

Optionally, the data writing sub-circuit includes a data writing transistor, the compensation control sub-circuit includes a compensation control transistor, where a control electrode of the data writing transistor is connected to the display scanning line, a first electrode of the data writing transistor is connected to the display data line, and a second electrode of the data writing transistor is connected to the first end of the driving circuit;

a control electrode of the compensation control transistor is connected to the display scanning line, a first electrode of the compensation control transistor is connected to the control end of the driving circuit, and a second electrode of the compensation control transistor is connected to the second end of the driving circuit.

Optionally, the voltage maintaining circuit includes a storage capacitor, and a first end of the storage capacitor is connected to the control end of the driving circuit, and a second end of the storage capacitor is connected to a third voltage end.

Optionally, the pixel driving circuit further includes a light-emitting control circuit;

the first end of the driving circuit is connected to the first voltage end via the light-emitting control circuit;

a control end of the light-emitting control circuit is connected to a light-emitting control line, and the light-emitting control circuit is configured to, in response to a light-emitting control signal input by the light-emitting control line, control the first end of the driving circuit and the first voltage end to connect to each other.

Optionally, the driving circuit includes a driving transistor;

a control electrode of the driving transistor is the control end of the driving circuit, a first electrode of the driving transistor is the first end of the driving circuit, and a second electrode of the driving transistor is the second end of the driving circuit.

A pixel driving method is further provided in the present disclosure, applied to the pixel driving circuit hereinabove, where a display period includes a first display phase including a first data writing period, a first charging period and a first light-emitting period which are set sequentially, the pixel driving method includes:

in the first data writing period, the control initial voltage end inputting a first control initial voltage, and the light-emitting duration control circuit, in response to a first reset signal input by the first reset end, switching off a connection between the second end of the driving circuit and the light-emitting element, according to the first control initial voltage;

in the first charging period, the control data line inputting a first control data voltage, and the driving circuit, under a control of a voltage of the control end of the driving circuit, controlling the first end of the driving circuit and the second end of the driving circuit to connect to each other; the light-emitting duration control circuit, in response to a control scanning signal input by the control scanning line, according to the first control initial voltage and a first control data voltage, switching on the connection between the second end of the driving circuit and the light-emitting element after entering a first charging time of the first charging period, to control the light-emitting element to emit light;

in the first light-emitting period, the driving circuit, under the control of the voltage of the control end of the driving circuit, switching on the connection between the first end of the driving circuit and the second end of the driving circuit, and the light-emitting duration control circuit switching on the connection between the second end of the driving circuit and the light-emitting element, to control the light-emitting element to emit light.

Optionally, the light-emitting duration control circuit includes a driving control sub-circuit, a driving control reset sub-circuit and a switching-on control sub-circuit;

the light-emitting duration control circuit, in response to the first reset signal input by the first reset end, switching off the connection between the second end of the driving circuit and the light-emitting element, according to the first control initial voltage, includes: the driving control reset sub-circuit, in response to the first reset signal, writing the control initial voltage into a control end of the driving control sub-circuit, to enable the driving control sub-circuit to switch off the connection between the second end of the driving circuit and the light-emitting element under a control of a voltage of the control end of the driving control sub-circuit;

the light-emitting duration control circuit, in response to the control scanning signal input by the control scanning line, according to the first control initial voltage and the first control data voltage, switching on the connection between the second end of the driving circuit and the light-emitting element after entering the first charging time of the first charging period, includes:

the driving control sub-circuit switching off the connection between the second end of the driving circuit and the light-emitting element under the control of the voltage of the control end of the driving control sub-circuit; the switching-on control sub-circuit, in response to the control scanning signal, charging the control end of the driving control sub-circuit with the first control data voltage, to enable the driving control sub-circuit to switch on the connection between the second end of the driving circuit and the light-emitting element under the control of the voltage of the control end of the driving control sub-circuit after entering the first charging time of the first charging period;

the light-emitting duration control circuit switching on the connection between the second end of the driving circuit and the light-emitting element includes:

the driving control sub-circuit switching on the connection between the second end of the driving circuit and the light-emitting element under the control of the voltage of the control end of the driving control sub-circuit.

Optionally, the pixel driving circuit further includes a voltage maintaining circuit and a data writing circuit, the pixel driving method further includes:

in the first data writing period, the data writing circuit, in response to a display scanning signal input by a display scanning line, controlling the voltage of the control end of the driving circuit according to a display data voltage; the voltage maintaining circuit maintaining the voltage of the control end of the driving circuit.

Optionally, the data writing circuit, in response to the display scanning signal input by the display scanning line, controlling the voltage of the control end of the driving circuit according to the display data voltage in the first data writing period, includes:

in the first data writing period, the data writing circuit, in response to the display scanning signal, writing the display data voltage Vdata1 into the first end of the driving circuit, and switching on the connection between the control end of the driving circuit and the second end of the driving circuit; the driving circuit switching on the connection between the first end of the driving circuit and the second end of the driving circuit under the control of the voltage of the control end of the driving circuit, to charge the control end of the driving circuit with the display data voltage Vdata1 until the driving circuit switches off the connection between the first end of the driving circuit and the second end of the driving circuit under the control of the voltage of the control end of the driving circuit.

Optionally, the pixel driving circuit further includes a reset circuit, and the first display phase further includes a setting period prior to the first data writing period, and the pixel driving method further includes:

in the setting period, the reset circuit, in response to a second reset signal input by a second reset end, writing a display initial voltage into the control end of the driving circuit, to enable the driving circuit to control the first end and the second end of the driving circuit to connect to each other under the control of the voltage of the control end of the driving circuit.

Optionally, the pixel driving circuit further includes a light-emitting control circuit, the pixel driving method further includes:

in the first data writing period, the light-emitting control circuit, in response to a light-emitting control signal input by a light-emitting control line, switching off a connection between the first end of the driving circuit and the first voltage end;

in the first charging period and the first light-emitting period, the light-emitting control circuit, in response to the light-emitting control signal, controlling the first end of the driving circuit and the first voltage end to connect to each other.

Optionally, the display period further includes at least one display phase subsequent to the first display period; an $n^{th}$ display phase includes an $n^{th}$ data writing period, an $n^{th}$ charging period and an $n^{th}$ light-emitting period; n is an integer greater than 1; the pixel driving method further includes:

in the $n^{th}$ data writing period, the control initial voltage end inputting an $n^{th}$ control initial voltage, and the light-emitting duration control circuit, in response to the first reset signal input by the first reset end, switching off the connection between the second end of the driving circuit and the light-emitting element, according to the $n^{th}$ control initial voltage;

in the $n^{th}$ charging period, the control data line inputting an $n^{th}$ control data voltage, and the driving circuit, under the control of the voltage of the control end of the driving circuit, controlling the first end of the driving circuit and the second end of the driving circuit to connect to each other; the light-emitting duration control circuit, in response to the control scanning signal input by the control scanning line, according to the $n^{th}$ control initial voltage and an $n^{th}$ control data voltage, switching on the connection between the second end of the driving circuit and the light-emitting element after entering an $n^{th}$ charging time of the $n^{th}$ charging period, to control the light-emitting element to emit light;

in the $n^{th}$ light-emitting period, the driving circuit, under the control of the voltage of the control end of the driving circuit, switching on the connection between the first end of the driving circuit and the second end of the driving circuit, and the light-emitting duration control circuit switching on the connection between the second end of the driving circuit and the light-emitting element, to control the light-emitting element to emit light.

Optionally, the light-emitting duration control circuit includes a driving control sub-circuit, a driving control reset sub-circuit and a switching-on control sub-circuit;

the light-emitting duration control circuit, in response to the first reset signal input by the first reset end, switching off the connection between the second end of the driving circuit and the light-emitting element, according to the $n^{th}$ control initial voltage, includes: the driving control reset sub-circuit, in response to the first reset signal, writing the $n^{th}$ control initial voltage into the control end of the driving control sub-circuit, to enable the driving control sub-circuit to switch off the connection between the second end of the driving circuit and the light-emitting element under the control of the voltage of the control end of the driving control sub-circuit;

the light-emitting duration control circuit, in response to the control scanning signal input by the control scanning line, according to the $n^{th}$ control initial voltage and the $n^{th}$ control data voltage, switching on the connection between the second end of the driving circuit and the light-emitting element after entering the $n^{th}$ charging time of the $n^{th}$ charging period, includes:

the driving control sub-circuit switching off the connection between the second end of the driving circuit and the light-emitting element under the control of the voltage of the control end of the driving control sub-circuit; the switching-on control sub-circuit, in response to the control scanning signal, charging the control end of the driving control sub-circuit with the $n^{th}$ control data voltage, to enable the driving control sub-circuit to switch on the connection between the second end of the driving circuit and the light-emitting element under the control of the voltage of the control end of the driving control sub-circuit after entering the $n^{th}$ charging time of the $n^{th}$ charging period.

Optionally, the $n^{th}$ control data voltage is equal to the first control data voltage; or the $n^{th}$ control initial voltage is equal to the first control initial voltage.

DETAILED DESCRIPTION

The technical solutions in the embodiments of the present disclosure will be described clearly and completely with reference to the drawings in the embodiments of the present disclosure, and it is obvious that the embodiments described are only some embodiments of the present disclosure, rather than all embodiments. All other embodiments, which can be derived by a person skilled in the art from the embodiments disclosed herein without any creative work, shall fall within the scope of the present disclosure.

The transistors used in all embodiments of the present disclosure may be triodes, thin film transistors, or field effect transistors or other devices with the same characteristics. In the embodiments of the present disclosure, to distinguish two electrodes of a transistor except for a control electrode, one electrode is referred to as a first electrode, and the other electrode is referred to as a second electrode.

In a practical operation, when the transistor is a triode, the control electrode may be a base electrode, the first electrode may be a collector electrode, and the second electrode may be an emitter electrode; alternatively, the control electrode may be a base electrode, the first electrode may be an emitter electrode, and the second electrode may be a collector electrode.

In a practical operation, when the transistor is a thin film transistor or a field effect transistor, the control electrode may be a gate electrode, the first electrode may be a drain electrode, and the second electrode may be a source electrode; alternatively, the control electrode may be a gate electrode, the first electrode may be a source electrode, and the second electrode may be a drain electrode.

Figure 1:
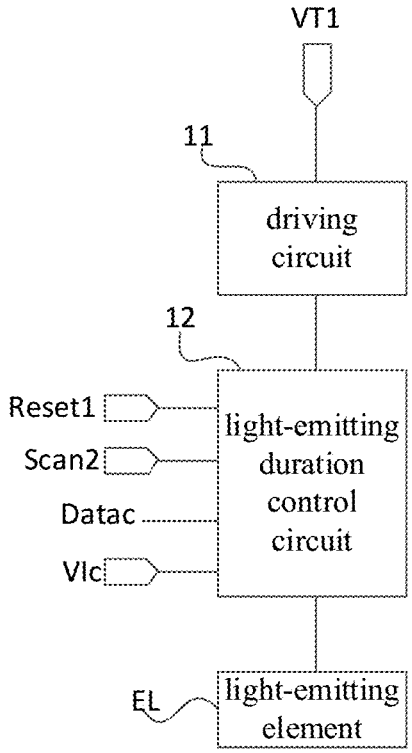
FIG. 1 is a structural view of a pixel driving circuit in an embodiment of the disclosure.

As shown in FIG. 1, a pixel driving circuit is provided in an embodiment of the present disclosure, applied to drive a light-emitting element EL, and including a driving circuit 11 and a light-emitting duration control circuit 12, where a first end of the driving circuit 11 is connected to a first voltage end VT1, a second end of the driving circuit 11 is connected to the light-emitting element EL via the light-emitting duration control circuit 12, and the driving circuit 11 is configured to, under a control of a voltage of a control end of the driving circuit 11, control the first end and the second end to connect to each other;

the light-emitting duration control circuit 12 is configured to, in response to a first reset signal input by a first reset end Reset1 and a control scanning signal input by a control scanning line Scan2, switch on or switch off a connection between the second end of the driving circuit 11 and the light-emitting element EL, according to a control data voltage input by a control data line Datac and a control initial voltage input by a control initial voltage end VIc, to control a light-emitting period of the light-emitting element EL.

According to the embodiment of the present disclosure, the pixel driving circuit controls the time of the connection between the second end of the driving circuit 11 and the light-emitting element EL through the light-emitting duration control circuit 12, so as to control the light-emitting period of the light-emitting element EL, thereby implementing different gray level displays.

In some embodiments of the present disclosure, the light-emitting element may be a Micro LED (Micro light-emitting diode), but is not limited thereto. In a practical operation, the light-emitting element may also be an organic light-emitting diode.

The pixel driving circuit in the embodiment of the disclosure adjusts the gray level together based on the driving current and the light-emitting time, so that the output characteristic of the micro light-emitting diode in the low gray level can be ensured, and the color shift of the micro light-emitting diode during the gray level change may be avoided.

Specifically, the first voltage end VT1 may be a high voltage end for inputting a high voltage Vdd, but is not limited thereto.

When the pixel driving circuit shown in FIG. 1 works, the display period includes a first display phase, where the first display phase includes a first data writing period, a first charging period, and a first light-emitting period that are sequentially set;

in the first data writing period, the control initial voltage end VIc inputs a first control initial voltage, and the light-emitting duration control circuit 12, under a control of a first reset signal input by the first reset end Reset1, switches off a connection between the second end of the driving circuit 11 and the light-emitting element EL, according to the first control initial voltage Vintc1;

in the first charging period, the control data line Datac inputs a first control data voltage Vdatac1, and the driving circuit 11, under a control of a voltage of the control end of the driving circuit, controls the first end of the driving circuit 11 and the second end of the driving circuit 11 to connect to each other; the light-emitting duration control circuit 12, under a control of a control scanning signal input by the control scanning line Scan2, according to the first control initial voltage Vintc1 and a first control data voltage Vdatac1, switches on the connection between the second end of the driving circuit 11 and the light-emitting element EL after entering a first charging time of the first charging period, to control the light-emitting element EL to emit light;

in the first light-emitting period, the driving circuit 11, under the control of the voltage of the control end of the driving circuit, switches on the connection between the first end of the driving circuit 11 and the second end of the driving circuit 11, and the light-emitting duration control circuit 12 switches on the connection between the second end of the driving circuit 11 and the light-emitting element EL, to control the light-emitting element EL to emit light.

When the first charging period starts, the light-emitting duration control circuit 12 switches off the connection between the second end of the driving circuit 11 and the light-emitting element EL. The light-emitting duration control circuit 12 switches on the connection between the second end of the driving circuit 11 and the light-emitting element EL after entering a first charging time of the first charging period, to control the light-emitting element EL to emit light.

In some embodiments of the present disclosure, the display period may be a frame display time.

When the pixel driving circuit shown in FIG. 1 of the present disclosure is in operation, where the display period further includes at least one display phase subsequent to the first display period; an $n^{th}$ display phase includes an $n^{th}$ data writing period, an $n^{th}$ charging period and an $n^{th}$ light-emitting period; n is an integer greater than 1;

in the $n^{th}$ data writing period, the control initial voltage end VIc inputs an $n^{th}$ control initial voltage Vintcn, and the light-emitting duration control circuit 12, under the control of the first reset signal input by the first reset end Reset1, switches off the connection between the second end of the driving circuit 11 and the light-emitting element EL, according to the $n^{th}$ control initial voltage Vintcn;

in the $n^{th}$ charging period, the control data line Datac inputs an $n^{th}$ control data voltage Vdatacn, and the driving circuit 11, under the control of the voltage of the control end of the driving circuit, controls the first end of the driving circuit 11 and the second end of the driving circuit 11 to connect to each other; the light-emitting duration control circuit 12, under a control of the control scanning signal input by the control scanning line Scan2, according to the $n^{th}$ control initial voltage Vintcn and an $n^{th}$ control data voltage Vdatacn, switches on the connection between the second end of the driving circuit 11 and the light-emitting element EL after entering an $n^{th}$ charging time of the $n^{th}$ charging period, to control the light-emitting element EL to emit light;

in the $n^{th}$ light-emitting period, the driving circuit 11, under the control of the voltage of the control end of the driving circuit 11, switches on the connection between the first end of the driving circuit 11 and the second end of the driving circuit 11, and the light-emitting duration control circuit 12 switches on the connection between the second end of the driving circuit 11 and the light-emitting element EL, to control the light-emitting element EL to emit light.

When the $n^{th}$ charging period starts, the light-emitting duration control circuit 12 switches off the connection between the second end of the driving circuit 11 and the light-emitting element EL, and the light-emitting duration control circuit 12 switches on the connection between the second end of the driving circuit 11 and the light-emitting element EL after entering an $n^{th}$ charging time of the $n^{th}$ charging period, to control the light-emitting element EL to emit light.

In the embodiment of the present disclosure, a display period (i.e., a frame display time) is divided into n display phases (n is an integer greater than 1), and in each display phase, a light-emitting time of the light-emitting element EL is determined by a corresponding control data voltage and a corresponding control initial voltage, so as to increase the number of gray levels.

Figure 2:
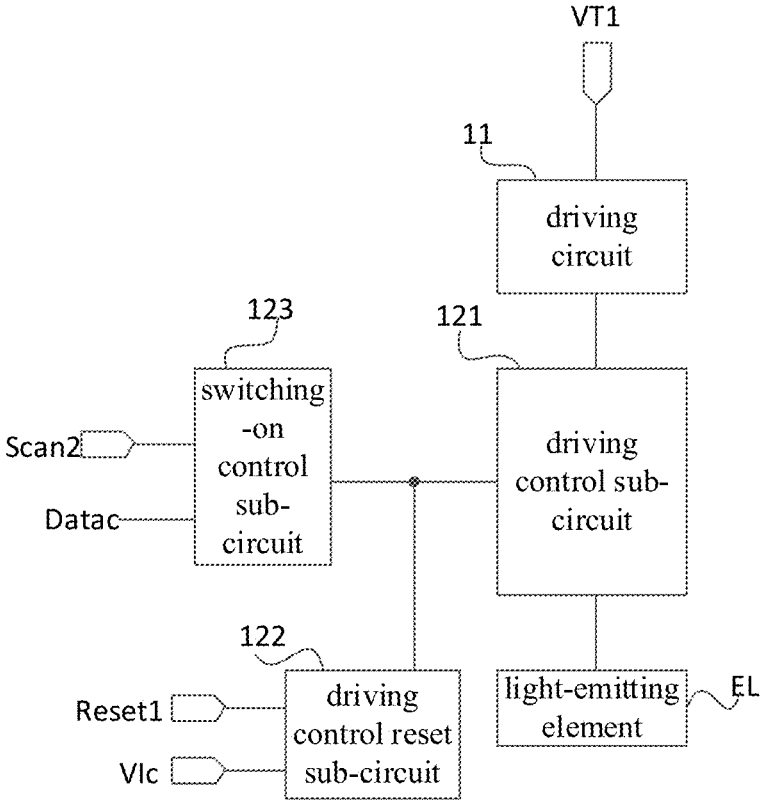
FIG. 2 is a structural view of a pixel driving circuit in some embodiments of the present disclosure.

As shown in FIG. 2, on the basis of the embodiment of the pixel driving circuit shown in FIG. 1, the light-emitting duration control circuit includes a driving control sub-circuit 121, a driving control reset sub-circuit 122 and a switching-on control sub-circuit 123, where a first end of the driving control sub-circuit 121 is connected to the second end of the driving circuit 11, and a second end of the driving control sub-circuit 121 is connected to the light-emitting element EL;

the driving control reset sub-circuit 122 is connected to the first reset end Reset1, the control initial voltage end VIc and the control end of the driving control sub-circuit 121, and is configured to, under a control of the first reset signal input by the first reset end Reset1, write the control initial voltage into a control end of the driving control sub-circuit 122, to enable the driving control sub-circuit 121 to switch off the connection between the second end of the driving circuit 11 and the light-emitting element EL under a control of a voltage of the control end of the driving control sub-circuit 121;

the switching-on control sub-circuit 123 is connected to the control Scan line Scan2, the control data line Datac and the control end of the driving control sub-circuit 121, and is configured to, under a control of the control scanning signal input by the control scan line Scan2, charge the control end of the driving control sub-circuit 121 with the control data voltage input by the control data line Datac, to enable the driving control sub-circuit 121 to switch on the connection between the second end of the driving circuit 11 and the light-emitting element EL under a control of a voltage of the control end of the driving control sub-circuit 121.

When the pixel driving circuit shown in FIG. 2 in the embodiment of the present disclosure is in operation, in the first data writing period, the control initial voltage end VIc inputs a first control initial voltage Vintc1, and the driving control reset sub-circuit 122, under a control of the first reset signal, writes the first control initial voltage Vintc1 into a control end of the driving control sub-circuit 121, to enable the driving control sub-circuit 121 to switch off the connection between the second end of the driving circuit 11 and the light-emitting element EL under a control of a voltage of the control end of the driving control sub-circuit 121;

in the first charging period, the control data line Datac inputs a first control data voltage Vdatac1, and the driving circuit 11, under a control of a voltage of the control end of the driving circuit 11, controls the first end of the driving circuit 11 and the second end of the driving circuit 11 to connect to each other, and the driving control sub-circuit 121 switches off the connection between the second end of the driving circuit 11 and the light-emitting element EL under the control of the voltage of the control end of the driving control sub-circuit 121; the switching-on control sub-circuit 123, in response to the control scanning signal, charges the control end of the driving control sub-circuit 121 with the first control data voltage Vdatac1, to enable the driving control sub-circuit 121 to switch on the connection between the second end of the driving circuit 11 and the light-emitting element EL under the control of the voltage of the control end of the driving control sub-circuit 121 after entering the first charging time of the first charging period;

in the first light-emitting period, the driving circuit 11, under the control of the voltage of the control end of the driving circuit 11, switches on the connection between the first end of the driving circuit 11 and the second end of the driving circuit 11, and the driving control sub-circuit 121 switches on the connection between the second end of the driving circuit 11 and the light-emitting element EL under the control of the voltage of the control end of the driving control sub-circuit 121.

In some embodiments of the present disclosure, the driving control sub-circuit 121 may include a driving control transistor, the control end of the driving control sub-circuit 121 is a gate of the driving control transistor, and in the first charging period, the switching-on control sub-circuit 123 controls the control end of the driving control sub-circuit 121 to be charged through the Vdatac1, to change the voltage of the control end of the driving control sub-circuit 121, so that the driving control transistor is switched from an off-state to an on-state.

When the pixel driving circuit shown in FIG. 2 of the present disclosure is in operation, in the $n^{th}$ data writing period, the control initial voltage end VIc inputs an $n^{th}$ control initial voltage Vintcn, and the driving control reset sub-circuit 122 writes the $n^{th}$ control initial voltage Vintcn into the control end of the driving control sub-circuit 121 under the control of the first reset signal, to enable the driving control sub-circuit 121 to switch off the connection between the second end of the driving circuit 11 and the light-emitting element EL under a control of a voltage of the control end of the driving control sub-circuit 121;

In the $n^{th}$ charging period, the control data line Datac inputs an $n^{th}$ control data voltage Vdatacn, and the driving circuit 11, under the control of the voltage of the control end of the driving circuit 11, controls the first end of the driving circuit 11 and the second end of the driving circuit 11 to connect to each other, and the driving control sub-circuit 121 switches off the connection between the second end of the driving circuit 11 and the light-emitting element EL under the control of the voltage of the control end of the driving control sub-circuit 121; the switching-on control sub-circuit 123 controls the control end of the driving control sub-circuit 121 to be charged by the $n^{th}$ control data voltage Vdatacn under the control of the control scan signal, to enable the driving control sub-circuit 121 to switch on the connection between the second end of the driving circuit 11 and the light-emitting element EL under a control of the voltage of the control end of the driving control sub-circuit 121 after entering an $n^{th}$ charging time of the $n^{th}$ charging period, to control the light-emitting element EL to emit light;

in the $n^{th}$ light-emitting period, the driving circuit 11, under the control of the voltage of the control end of the driving circuit 11, switches on the connection between the first end of the driving circuit 11 and the second end of the driving circuit 11, the driving control sub-circuit 121 switches on the connection between the second end of the driving circuit 11 and the light-emitting element EL under the control of the voltage of the control end of the driving control sub-circuit 121, and the driving circuit 11 drives the light-emitting element EL to emit light.

Specifically, the switching-on control sub-circuit may include a first switching-on control transistor, a second switching-on control transistor, and a switching-on control capacitor;

a control electrode of the first switching-on control transistor is connected to the control end of the driving control sub-circuit, a first electrode of the first switching-on control transistor is connected to a first electrode of the second switching-on control transistor, and a second electrode of the first switching-on control transistor is connected to the control data line; the control data line is configured to input the control data voltage;

a control electrode of the second switching-on control transistor is connected to the control scanning line, and a second electrode of the second switching-on control transistor is connected to the control end of the driving control sub-circuit; and a first end of the switching-on control capacitor is connected to the control end of the driving control sub-circuit, and a second end of the switching-on control capacitor is connected to a second voltage end.

In some embodiments of the present disclosure, the second voltage end may be a high voltage end, but is not limited thereto.

Specifically, the driving control reset sub-circuit may include a driving control reset transistor;

a control electrode of the driving control reset transistor is connected to the first reset end, a first electrode of the driving control reset transistor is connected to the control end of the driving control sub-circuit, and a second electrode of the driving control reset transistor is connected to the control initial voltage end; the control initial voltage end is configured to input the control initial voltage.

Specifically, the driving control sub-circuit may include a driving control transistor;

a control electrode of the driving control transistor is the control end of the driving control sub-circuit, a first electrode of the driving control transistor is the first end of the driving control sub-circuit, and a second electrode of the driving control transistor is the second end of the driving control sub-circuit.

Figure 3:
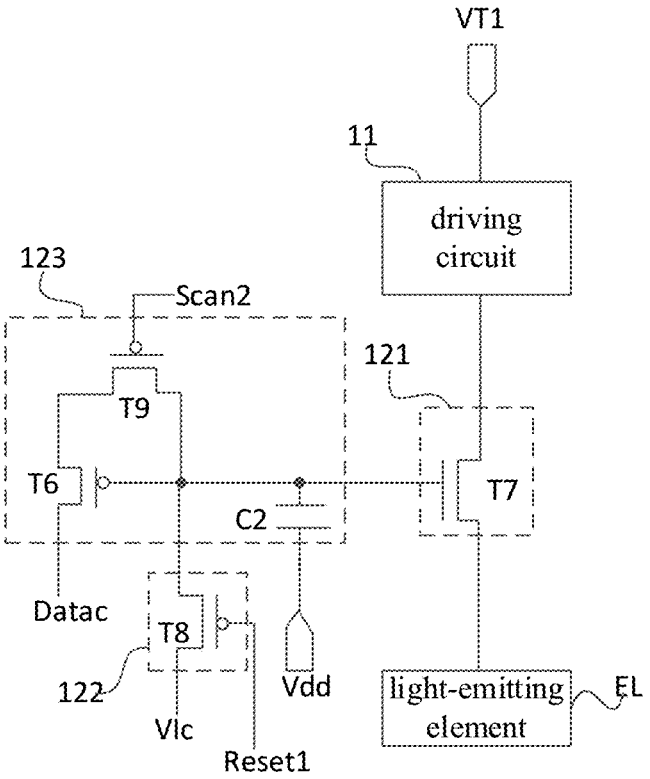
FIG. 3 is a structural view of a pixel driving circuit in some embodiments of the present disclosure.

As shown in FIG. 3, on the basis of the pixel driving circuit shown in FIG. 2, the switching-on control sub-circuit 123 includes a first switching-on control transistor T6, a second switching-on control transistor T9 and a switching-on control capacitor C2; the driving control reset sub-circuit 122 includes a driving control reset transistor T8; the driving control sub-circuit 121 includes a driving control transistor T7;

the gate of the driving control transistor T7 is the control end of the driving control sub-circuit 121, the drain of the driving control transistor T7 is the first end of the driving control sub-circuit 121, and the source of the driving control transistor T7 is the second end of the driving control sub-circuit 121;

the gate of the first on-control transistor T6 is connected to the gate of the driving control transistor T7, the source of the first on-control transistor T6 is connected to the source of the second on-control transistor T9, and the drain of the first on-control transistor T6 is connected to a control data line Datac; the control data line Datac is configured to input the control data voltage;

the gate of the second switching-on control transistor T9 is connected to the control Scan line Scan2, and the drain of the second switching-on control transistor T9 is connected to the gate of the driving control transistor T7;

a first end of the switching-on control capacitor C2 is connected to the gate of the driving control transistor T7, and a second end of the switching-on control capacitor C2 is connected to the high-voltage end; the high voltage end is configured to input a high voltage Vdd;

the gate of the driving control Reset transistor T8 is connected to the first reset end Reset1, the source of the driving control Reset transistor T8 is connected to the gate of the driving control transistor T7, and the drain of the driving control Reset transistor T8 is connected to the control initial voltage end VIc; the control initial voltage end VIc is configured to input the control initial voltage.

In the embodiment of the pixel driving circuit shown in FIG. 3, T6, T8 and T9 are all P-type thin film transistors, and T7 is an N-type thin film transistor, but not limited thereto.

When the pixel driving circuit shown in FIG. 3 of the present disclosure is in operation, in the first data writing period, VIc inputs a first control initial voltage Vintc1, Reset1 inputs a low level, T8 is turned on to write Vintc1 into the gate of T7 and the gate of T6, so that T7 is turned off, the connection between the second end of the driving circuit 11 and the light-emitting element EL is switched off, and T6 is turned on;

in the first charging period, T7 is turned off to switch off the connection between the second end of the driving circuit 11 and the light-emitting element EL; the Datac inputs the first control data voltage Vdatac1 and the Scan2 inputs a low level, both T6 and T9 are turned on to charge C2 through Vdatac1 to boost the voltage of the gate of T7, so that after entering the first charging time of the first charging period, T7 is switched from an off-state to an on-state; thereafter, T6 and T9 may be turned on and the C2 is charged with Vdatac1 until the voltage at the gate of T7 rises to Vdatac1+Vthc, T6 is turned off, and the charging is stopped, where Vthc is a threshold voltage of T6;

in the first light-emitting period, T7 is turned on to switch on the connection between the second end of the driving circuit 11 and the light-emitting element EL.

In some embodiments, the first charging duration is associated with Vintc1 and Vdatac1.

The embodiment of the pixel driving circuit shown in FIG. 3 of the present disclosure is in operation, in the $n^{th}$ data writing period, VIc inputs an $n^{th}$ control initial voltage Vintcn, Reset1 inputs a low level, T8 is turned on to write Vintcn to the gate of T7 and the gate of T6, so that T7 is turned off, the connection between the second end of the driving circuit 11 and the light-emitting element EL is switched off, and T6 is turned on;

in the $n^{th}$ charging period, T7 is turned off to switch off the connection between the second end of the driving circuit 11 and the light-emitting element EL; the Datac inputs the $n^{th}$ control data voltage Vdatacn and the Scan2 inputs the low level, both T6 and T9 are turned on to charge C2 through Vdatacn to boost the voltage of the gate of T7, so that after entering the $n^{th}$ charging time of the $n^{th}$ charging period, T7 is switched from the off-state to the on-state; thereafter, T6 and T9 may be turned on and the C2 is charged with Vdatacn until the voltage at the gate of T7 rises to Vdatacn+Vthc, T6 is turned off, the charging is stopped; where Vthc is a threshold voltage of T6;

in the $n^{th}$ light-emitting period, T7 is turned on to switch on the connection between the second end of the driving circuit 11 and the light-emitting element EL.

In some embodiments, the pixel driving circuit may further include a reset circuit;

the reset circuit is configured to, in response to a second reset signal input by a second reset end, write a display initial voltage into the control end of the driving circuit, to enable the driving circuit to control the first end and the second end of the driving circuit to connect to each other under the control of the voltage of the control end of the driving circuit.

Figure 4:
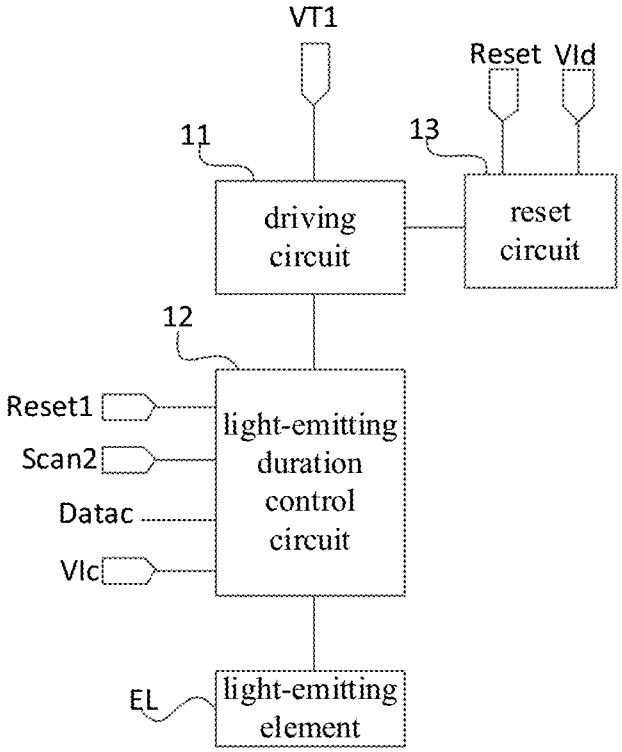
FIG. 4 is a structural view of a pixel driving circuit in some embodiments of the present disclosure.

As shown in FIG. 4, on the basis of the pixel driving circuit shown in FIG. 1, the pixel driving circuit in some embodiments of the present disclosure further includes a reset circuit 13;

the reset circuit 13 is connected to the second reset end Reset, the display initial voltage end VId, and the control end of the driving circuit 11, and is configured to write the display initial voltage input by the display initial voltage end VId into the control end of the driving circuit 11 under the control of the second reset signal input by the second reset end Reset, to enable the driving circuit 11 to switch on the connection between the first end of the driving circuit 11 and the second end of the driving circuit 11 under the control of the voltage at the control end of the driving circuit 11.

When the pixel driving circuit shown in FIG. 4 of the present disclosure works, the first display phase further includes a setting period set before the first data writing period, and in the setting period, the reset circuit 13, under a control of a second reset signal input by a second reset end Reset, writes a display initial voltage into the control end of the driving circuit 11, to enable the driving circuit 11 to control the first end and the second end of the driving circuit 11 to connect to each other under the control of the voltage of the control end of the driving circuit 11.

Specifically, the reset circuit may include a reset transistor;

the control electrode of the reset transistor is connected to the second reset end, the first electrode of the reset transistor is connected to the display initial voltage end, and the second electrode of the reset transistor is connected to the control end of the driving circuit.

In some embodiments, the pixel driving circuit in the present disclosure may further include a voltage maintaining circuit and a data writing circuit;

the voltage maintaining circuit is connected to the control end of the driving circuit and configured to maintain the voltage of the control end of the driving circuit;

the data writing circuit is configured to, under a control of a display scanning signal input by a display scanning line, control the voltage of the control end of the driving circuit according to a display data voltage input by a display data line.

Figure 5:
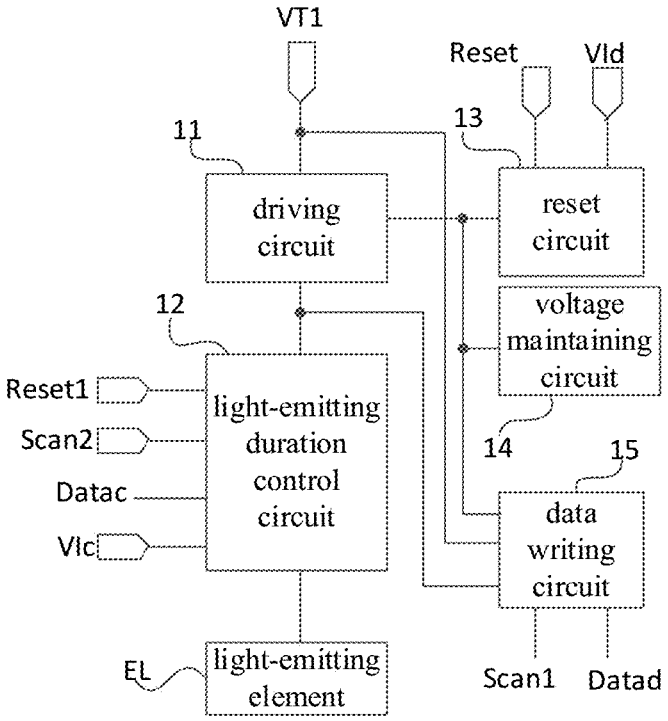
FIG. 5 is a structural view of a pixel driving circuit in some embodiments of the present disclosure.

As shown in FIG. 5, on the basis of the pixel driving circuit shown in FIG. 4, the pixel driving circuit in some embodiments of the present disclosure further includes a voltage maintaining circuit 14 and a data writing circuit 15;

the voltage maintaining circuit 14 is connected to the control end of the driving circuit 11, and is configured to maintain the voltage at the control end of the driving circuit 11;

the data writing circuit 15 is connected to the display scan line Scan1, the display data line Datad, the control end of the driving circuit 11, the first end of the driving circuit 11 and the second end of the driving circuit 11, and is configured to control a voltage of the control end of the driving circuit 11 according to a display data voltage input by the display data line Datad and under a control of a display scan signal input by the display scan line Scan 1.

When the pixel driving circuit shown in FIG. 5 in the present disclosure is in operation, in the first data writing period, the data writing circuit 15 writes the display data voltage Vdata1 into the first end of the driving circuit 22 under the control of the display scanning signal, and switches on the connection between the control end of the driving circuit 11 and the second end of the driving circuit 11; the driving circuit 11 switches on the connection between the first end of the driving circuit 11 and the second end of the driving circuit 11 under the control of the voltage of the control end of the driving circuit 11, so as to charge the control end of the driving circuit 11 with the display data voltage Vdata1, until the driving circuit 11 switches off the connection between the first end of the driving circuit 11 and the second end of the driving circuit 11 under the control of the voltage of the control end of the driving circuit 11, so as to control the potential of the control end of the driving circuit 11 to be Vdata1+Vth, and Vth is the threshold voltage of the driving transistor of the driving circuit 11, thereby realizing a threshold voltage compensation. According to the embodiment of the disclosure, it is able to counteract the influence of the threshold voltage difference on the driving current of the light-emitting element.

Specifically, the data writing circuit may include a data writing sub-circuit and a compensation control sub-circuit, where the data writing sub-circuit is configured to, under the control of the display scanning signal, write the display data voltage into the first end of the driving circuit;

the compensation control sub-circuit is configured to, under the control of the display scanning signal, control the control end of the driving circuit and the second end of the driving circuit to connect to each other.

Figure 6:
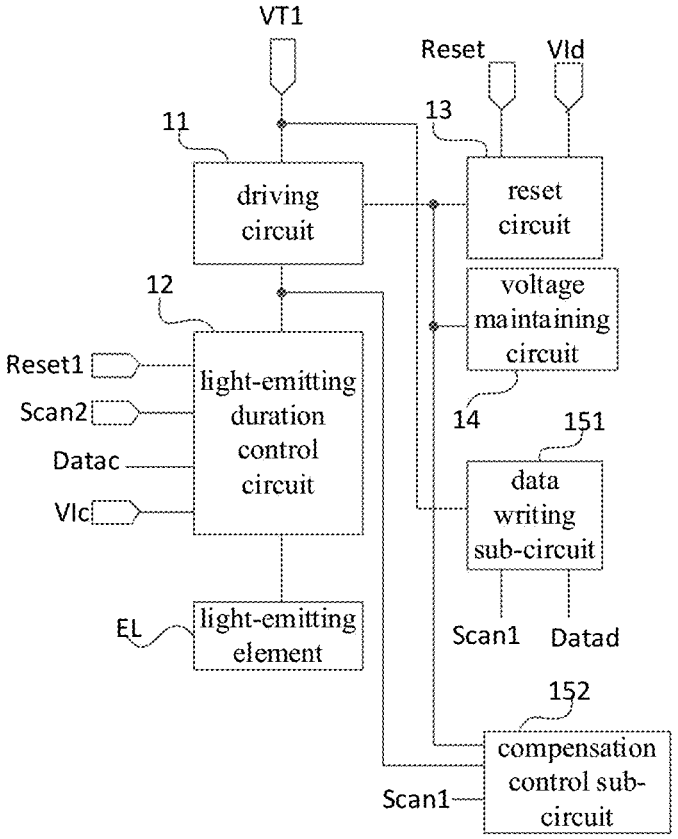
FIG. 6 is a structural view of a pixel driving circuit in some embodiments of the present disclosure.

Specifically, as shown in FIG. 6, on the basis of the pixel driving circuit shown in FIG. 5, the data writing circuit includes a data writing sub-circuit 151 and a compensation control sub-circuit 152, where the data writing sub-circuit 151 is connected to the display scan line Scan1, the display data line Datad and the first end of the driving circuit 11, and is configured to write the display data voltage into the first end of the driving circuit 11 under the control of the display scan signal;

the compensation control sub-circuit 152 is connected to the display scan line Scan1, the control end of the driving circuit 11 and the second end of the driving circuit 11, and is configured to switch on the connection between the control end of the driving circuit 11 and the second end of the driving circuit 11 under the control of the display scan signal.

Specifically, the data writing sub-circuit may include a data writing transistor, and the compensation control sub-circuit may include a compensation control transistor, where a control electrode of the data writing transistor is connected to the display scanning line, a first electrode of the data writing transistor is connected to the display data line, and a second electrode of the data writing transistor is connected to the first end of the driving circuit;

a control electrode of the compensation control transistor is connected to the display scanning line, a first electrode of the compensation control transistor is connected to the control end of the driving circuit, and a second electrode of the compensation control transistor is connected to the second end of the driving circuit.

Specifically, the voltage maintaining circuit includes a storage capacitor, and a first end of the storage capacitor is connected to the control end of the driving circuit, and a second end of the storage capacitor is connected to a third voltage end.

In some embodiments of the present disclosure, the third voltage end may be a high voltage end, but is not limited thereto.

Figure 7:
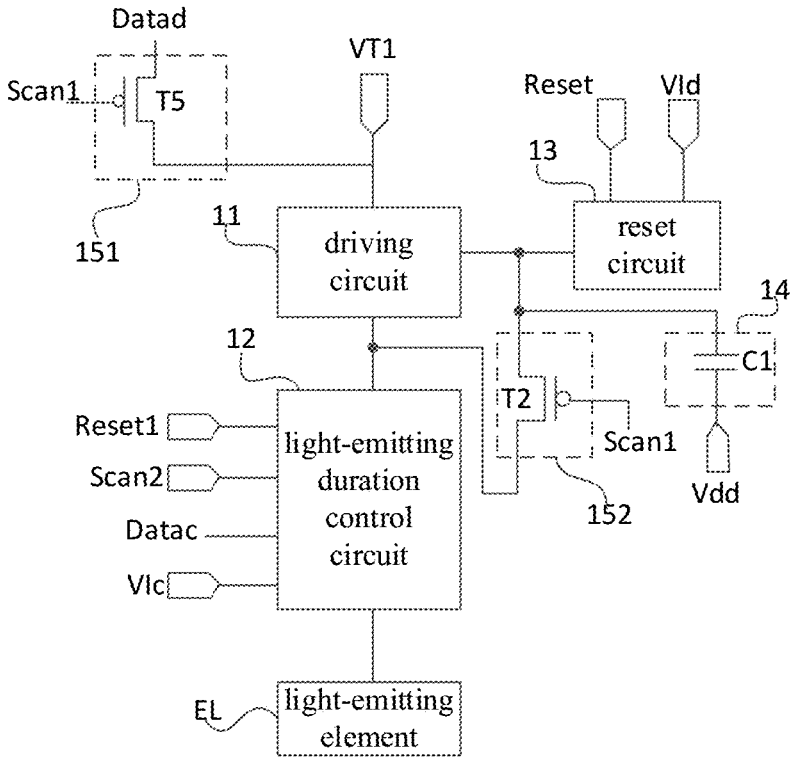
FIG. 7 is a structural view of a pixel driving circuit in some embodiments of the present disclosure.

As shown in FIG. 7, on the basis of the pixel driving circuit shown in FIG. 6, the data writing sub-circuit 151 includes a data writing transistor T5, and the compensation control sub-circuit 152 includes a compensation control transistor T2, where the gate of the data writing transistor T5 is connected to the display scan line Scan1, the source of the data writing transistor T5 is connected to the display data line Datad, and the drain of the data writing transistor T5 is connected to the first end of the driving circuit 11;

the gate of the compensation control transistor T2 is connected to the display scan line Scan1, the source of the compensation control transistor T2 is connected to the control end of the driving circuit 11, and the drain of the compensation control transistor T2 is connected to the second end of the driving circuit 11;

the voltage maintaining circuit 14 includes a storage capacitor C1; a first end of the storage capacitor C1 is connected to the control end of the driving circuit 11, and a second end of the storage capacitor C1 is connected to the high-voltage end of the input high voltage Vdd.

In the embodiment of the pixel driving circuit shown in FIGS. 7, T5 and T2 may be P-type thin film transistors, but are not limited thereto.

When the pixel driving circuit shown in FIG. 7 is in operation, in the first data writing period, the display scan signal input by Scan1 is at low level, both T5 and T2 are turned on, the display data voltage Vdata1 is input to the display data line Datad, so as to write Vdata1 into the first end of the driving circuit 11, to enable the first end of the driving circuit 11 and the second end of the driving circuit 11 to connect to each other, so as to charge the storage capacitor C1 with the display data voltage Vdata1, until the driving circuit 11, under the control of the voltage at the control end of the driving circuit 11, switches off the connection between the first end of the driving circuit 11 and the second end of the driving circuit 11, so as to control the potential at the control end of the driving circuit 11 to be Vdata1+Vth, and Vth is the threshold voltage of the driving transistor in the driving circuit 11, so as to realize a threshold voltage compensation.

In some embodiments, the pixel driving circuit of the present disclosure may further include a light-emitting control circuit;

the first end of the driving circuit is connected to the first voltage end through the light-emitting control circuit;

the control end of the light-emitting control circuit is connected to a light-emitting control line, and the light-emitting control circuit is configured to enable the first end of the driving circuit and the first voltage end to connect to each other under a control of a light-emitting control signal input by the light-emitting control line.

Figure 8:
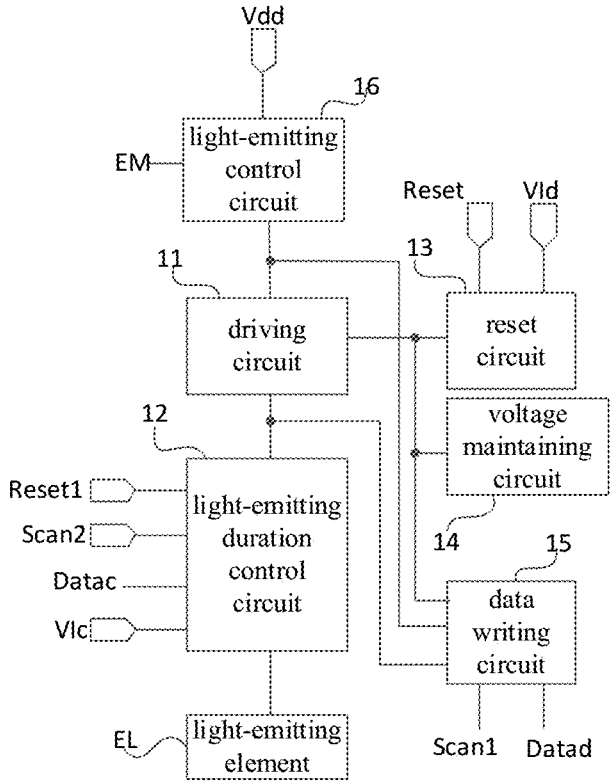
FIG. 8 is a structural view of a pixel driving circuit in some embodiments of the present disclosure.

As shown in FIG. 8, on the basis of the pixel driving circuit shown in FIG. 5, the pixel driving circuit in the embodiments of the present disclosure further includes a light-emitting control circuit 16;

a first end of the driving circuit 11 is connected to a high voltage end for inputting a high voltage Vdd through the light-emitting control circuit 16;

the control end of the light-emitting control circuit 16 is connected to the light-emitting control line EM, and the light-emitting control circuit 16 is configured to enable the first end of the driving circuit 11 and the high-voltage end to connect o each other under the control of the light-emitting control signal input by the light-emitting control line EM.

In the embodiment shown in FIG. 8, the first voltage end is the high voltage end, but not limited thereto.

Specifically, the light-emitting control circuit may include a light-emitting control transistor;

the control electrode of the light-emitting control transistor is connected to the light-emitting control line EM, the first electrode of the light-emitting control transistor is connected to the first end of the driving circuit 11, and the second electrode of the light-emitting control transistor is connected to the high voltage end.

Specifically, the driving circuit may include a driving transistor;

the control electrode of the driving transistor is a control end of the driving circuit, the first electrode of the driving transistor is a first end of the driving circuit, and the second electrode of the driving transistor is a second end of the driving circuit.

The pixel driving circuit in the present disclosure is described below with some embodiments.

Figure 9:
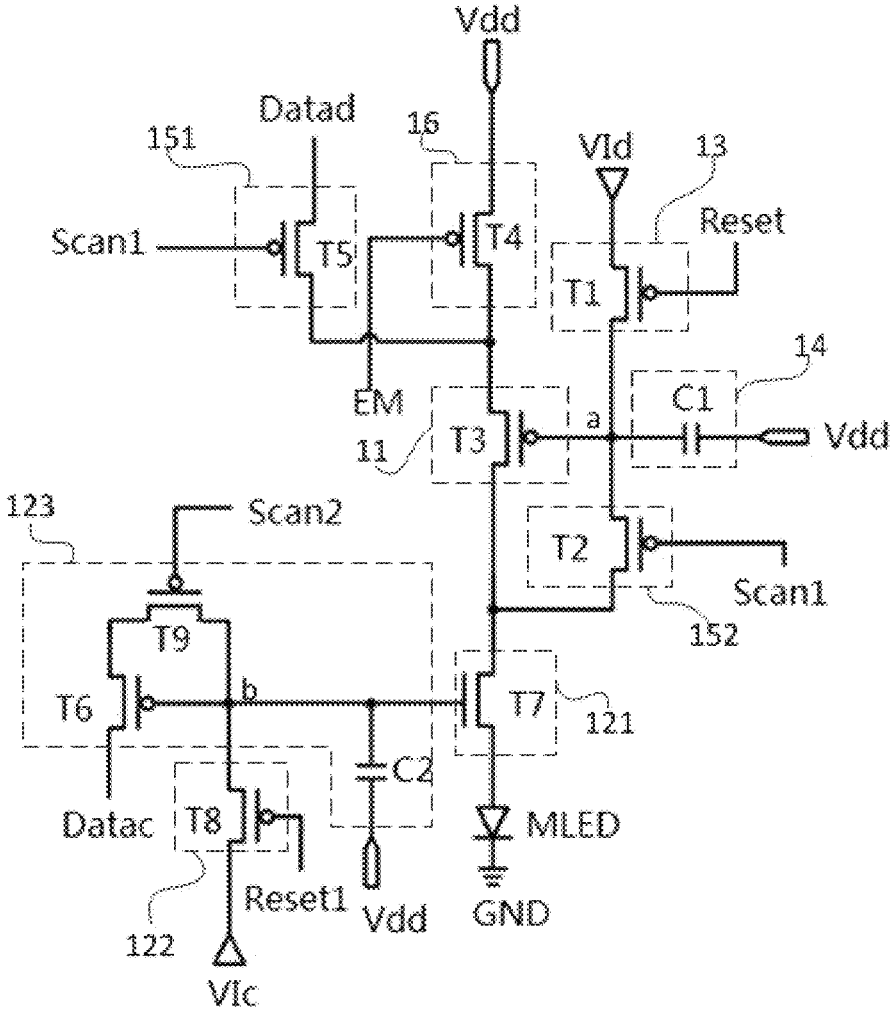
FIG. 9 is a circuit diagram of a pixel driving circuit in an embodiment of the present disclosure.

As shown in FIG. 9, the pixel driving circuit in some embodiments of the present disclosure are used for driving a micro light-emitting diode MLED, and the pixel driving circuit in some embodiments of the present disclosure includes a driving circuit 11, a light-emitting duration control circuit 12, a reset circuit 13, a voltage maintaining circuit 14, a data writing circuit 15, and a light-emitting control circuit 16;

the light-emitting duration control circuit includes a driving control sub-circuit 121, a driving control reset sub-circuit 122, and a switching-on control sub-circuit 123;

the driving circuit 11 includes a driving transistor T3; the light-emitting control circuit 16 includes a light-emitting control transistor T4; the voltage maintaining circuit 14 includes a storage capacitor C1;

the gate of the driving transistor T3 is connected to the first end of the storage capacitor C1; a second end of the storage capacitor C1 is connected to a high-voltage end of the input high voltage Vdd;

the source of the driving transistor T3 is connected to the drain of the light-emitting controlling transistor T4; a gate of the light-emitting control transistor T4 is connected to an light-emitting control line EM, and a source of the light-emitting control transistor T4 is connected to the high voltage end;

the switching-on control sub-circuit 123 includes a first switching-on control transistor T6, a second switching-on control transistor T9 and a switching-on control capacitor C2; the driving control reset sub-circuit 122 includes a driving control reset transistor T8; the driving control sub-circuit 121 includes a driving control transistor T7;

the drain of the driving transistor T3 is connected to the drain of the driving control transistor T7, and the source of the driving control transistor T7 is connected to the anode of the micro light-emitting diode MLED; the cathode of the micro light-emitting diode MLED is connected to a ground end GND;

the gate of the first on-control transistor T6 is connected to the gate of the driving control transistor T7, the source of the first on-control transistor T6 is connected to the source of the second on-control transistor T9, and the drain of the first on-control transistor T6 is connected to a control data line Datac;

the gate of the second switching-on control transistor T9 is connected to the control Scan line Scan2, and the drain of the second switching-on control transistor T9 is connected to the gate of the driving control transistor T7;

a first end of the switching-on control capacitor C2 is connected to the gate of the driving control transistor T7, and a second end of the switching-on control capacitor C2 is connected to the high-voltage end;

the gate of the driving control Reset transistor T8 is connected to the first reset end Reset1, the source of the driving control Reset transistor T8 is connected to the gate of the driving control transistor T7, and the drain of the driving control Reset transistor T8 is connected to the control initial voltage end VIc;

the reset circuit 13 includes a reset transistor T1;

the gate of the Reset transistor T1 is connected to a second reset end Reset, the source of the Reset transistor T1 is connected to the display initial voltage end VId, and the drain of the Reset transistor T1 is connected to the gate of the driving transistor T3;

the data writing circuit includes a data writing sub-circuit 151 and a compensation control sub-circuit 152, where the data writing sub-circuit 151 includes a data writing transistor T5, and the compensation control sub-circuit 152 includes a compensation control transistor T2, where the gate of the data writing transistor T5 is connected to the display scan line Scan1, the source of the data writing transistor T5 is connected to the display data line Datad, and the drain of the data writing transistor T5 is connected to the first end of the driving circuit 11;

the gate of the compensation control transistor T2 is connected to the display scan line Scan1, the source of the compensation control transistor T2 is connected to the control end of the driving circuit 11, and the drain of the compensation control transistor T2 is connected to the second end of the driving circuit 11;

In the pixel driving circuit shown in FIG. 9, T7 is an N-type thin film transistor, and the rest transistors are P-type thin film transistors, but not limited thereto.

In FIG. 9, a node a is a node connected to the gate of T3, and a node b is a node connected to the gate of T7.

Figure 10:
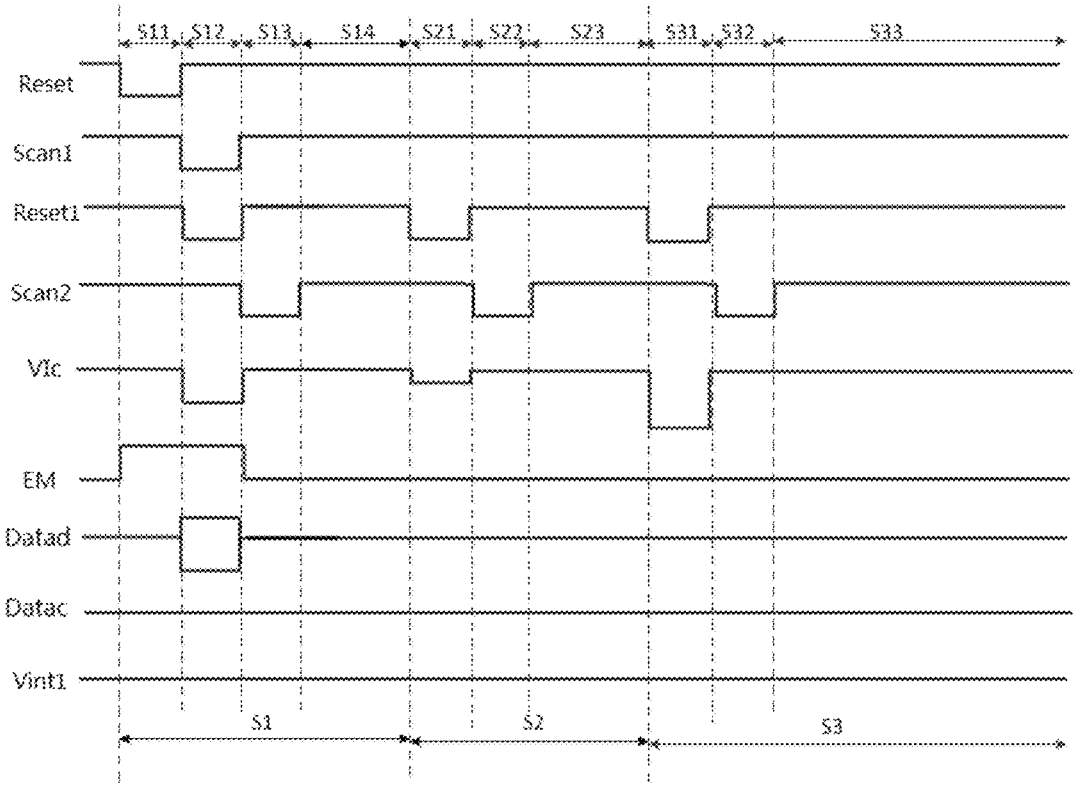
FIG. 10 is an operation timing diagram of the pixel driving circuit shown in FIG. 9 in the present disclosure.
Figure 11A:
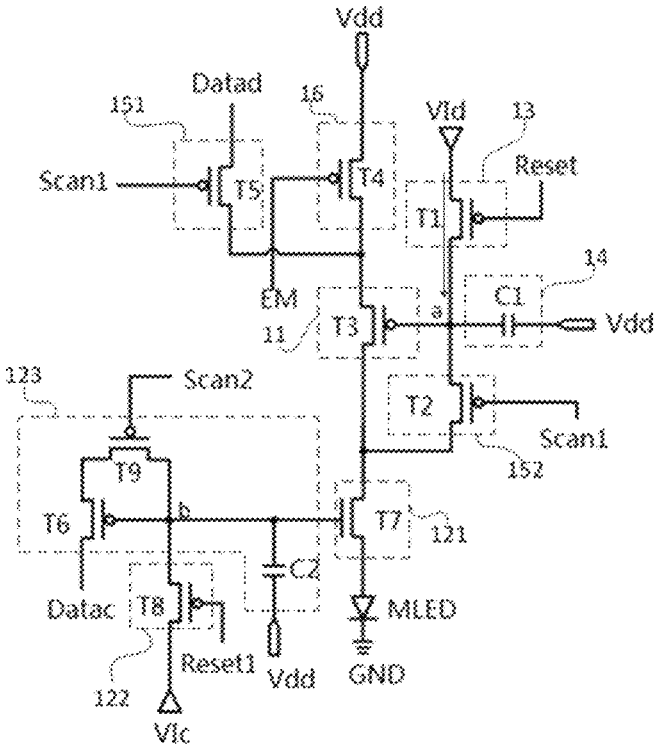
FIG. 11A is a schematic diagram illustrating an operating state of the pixel driving circuit shown in FIG. 9 in a setting period S11 in the present disclosure.
Figure 11B:
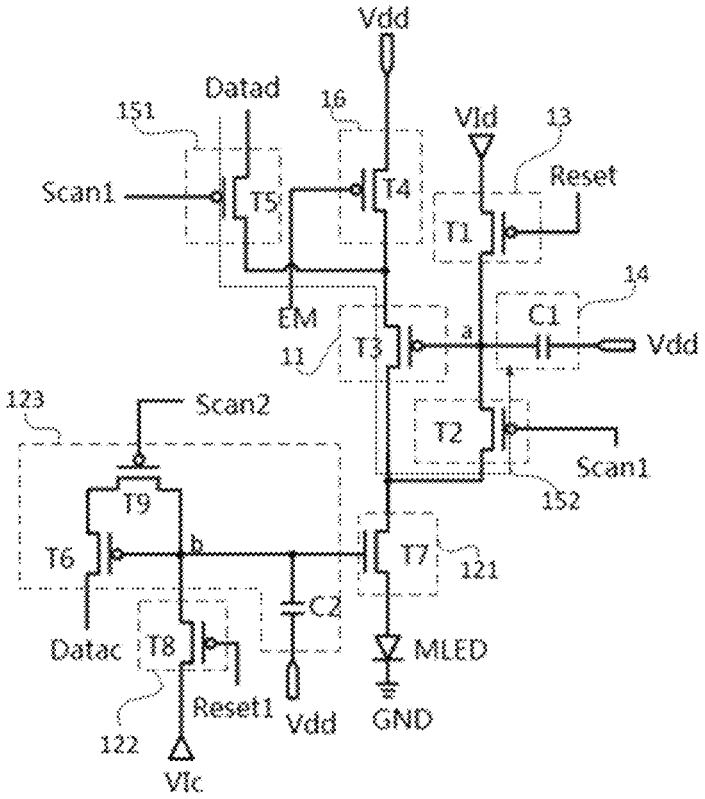
FIG. 11B is a schematic diagram illustrating an operating state of the pixel driving circuit shown in FIG. 9 in a first data writing period S12 in the present disclosure.
Figure 11C:
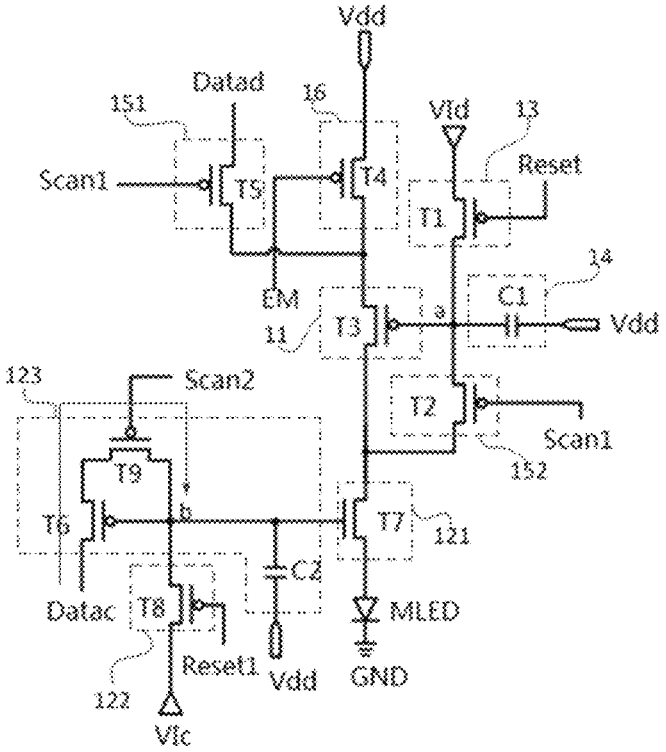
FIG. 11C is a schematic diagram illustrating an operating state of the pixel driving circuit shown in FIG. 9 in a first charging period S13 in the present disclosure.
Figure 11D:
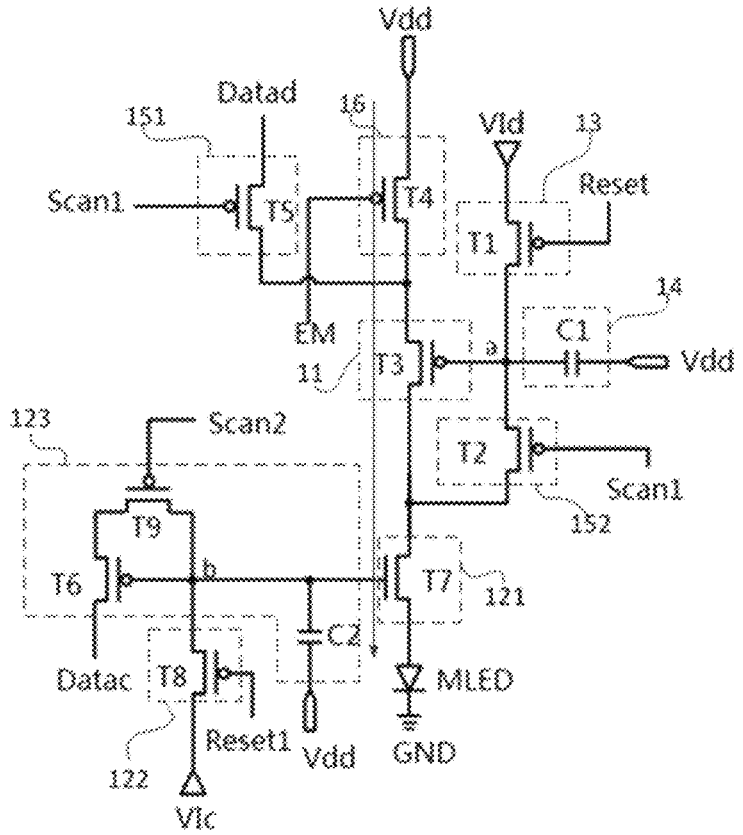
FIG. 11D is a schematic diagram illustrating an operating state of the pixel driving circuit shown in FIG. 9 in a first light-emitting period S14 in the embodiment of the present disclosure.

As shown in FIG. 10, when the pixel driving circuit shown in FIG. 9 of the present disclosure is in operation, the display period includes the first display phase S1, the second display phase S2 and the third display phase S3;

the first display phase S1 includes a setting period S11, a first data writing period S12, a first charge period S13, and a first light-emitting period S14;

the second display phase S2 includes a second data writing period S21, a second charging period S22, and a second light-emitting period S23;

the third display phase S3 includes a third data writing period S31, a third charging period S32, and a third light-emitting period S33;

in the first display phase S1, in the setting period S11, the Reset is at a low level, and Scan1, Reset1, Scan2, and EM are all at a high level, as shown in FIG. 11A, T1 is turned on, and a display initial voltage Vint1 is input to the VId and written to the gate of T3 to reset the potential of T3 to Vint1, so that T3 can be turned on;

in the first data writing period S12, the Reset is at a high level, Scan1 and Reset1 are both at a low level, Scan2 and EM are both at a high level, Datad inputs a display data voltage Vdata1, VIc inputs a first control initial voltage Vintc1, T1 is turned off, as shown in FIG. 11B, T5, T3 and T2 are turned on, and T8 is turned on, C1 is charged by Vdata1 to control boosting the voltage of the gate of T3 until the voltage of the gate of T3 becomes Vdata1+Vth, T3 is turned off, the charging is stopped, Vth is a threshold voltage of T3; and T8 is turned on to write Vintc1 to the gate of T7 and the gate of T6, such that T7 is turned off and T6 is turned on in preparation for charging, where Vintc1 is adjustable;

in a first charging period S13, Reset and Scan1 are at a high level, Scan2 and EM are both at a low level, T4 is turned on, so that the source of T3 is connected to Vdd, T3 is turned on, and Datac inputs a first control data voltage Vdatac1, as shown in FIG. 11C, T6 and T9 are turned on to charge C2 with Vdatac1 to gradually raise the voltage of the gate of T7, so that after entering a first charging time of the first charging period S13, T7 is switched from an off-state to an on-state to control the MLED to emit light; thereafter, T6 and T9 are turned on, C2 is charged through Vdatac1 until the voltage at the gate of T6 rises to Vdatac1+Vthc, where Vthc is the threshold voltage of T6, and T6 is turned off, and the charging is stopped;

in the first light-emitting period S14, the EM is at a low level, and T4, T3 and T7 are all turned on to drive the MLED to emit light;

in the second display phase S2, in the second data writing period S21, Reset is at a high level, Scan1 and Reset1 are both at a low level, Scan2 and EM are both at a high level, Datad inputs a display data voltage Vdata1, VIc inputs a second control initial voltage Vintc2, T1 is turned off, T5, T3 and T2 are turned on, and T8 is turned on, C1 is charged by Vdata1 to control boosting of the voltage of the gate of T3 until the voltage of the gate of T3 becomes Vdata1+Vth, T3 is turned off, the charging is stopped, Vth is a threshold voltage of T3; and T8 is turned on to write Vintc2 to the gate of T7 and the gate of T6, such that T7 is turned off and T6 is turned on in preparation for charging, where Vintc2 is adjustable;

in a second charging period S22, Reset and Scan1 are both at a high level, Scan2 and EM are both at a low level, T4 is turned on, so that the source of T3 is connected to Vdd, T3 is turned on, Datac inputs a second control data voltage Vdatac2, T6 and T9 are turned on, so as to charge C2 through Vdatac2 to gradually raise the voltage of the gate of T7, so that after entering the second charging period S22 of a second charging time, T7 is switched from an off-state to an on-state to control the MLED to emit light; thereafter, T6 and T9 are turned on, C2 is charged with Vdatac2 until the voltage at the gate of T6 rises to Vdatac2+Vthc, where Vthc is the threshold voltage of T6, and T6 is turned off, the charging is stopped;

in the second light-emitting period S23, the EM is at a low level, and T4, T3, and T7 are all turned on to drive the MLED to emit light;

in the third display phase S3, in the third data writing period S31, Reset is at a high level, Scan1 and Reset1 are both at a low level, Scan2 and EM are both at a high level, Datad inputs a display data voltage Vdata1, VIc inputs a third control initial voltage Vintc3, T1 is turned off, T5, T3 and T2 are turned on, and T8 is turned on, C1 is charged with Vdata1 to control the voltage of the gate of T3 to be boosted until the voltage of the gate of T3 becomes Vdata1+Vth, T3 is turned off, the charging is stopped, and Vth is a threshold voltage of T3; and T8 is turned on to write Vintc3 to the gate of T7 and the gate of T6, such that T7 is turned off and T6 is turned on in preparation for charging, where Vintc3 is adjustable;

in a third charging period S32, Reset and Scan1 are both at a high level, Scan2 and EM are both at a low level, T4 is turned on, so that the source of T3 is connected to Vdd, T3 is turned on, Datac inputs a third control data voltage Vdatac3, T6 and T9 are turned on, so as to charge C2 through Vdatac3 to gradually raise the voltage of the gate of T7, so that after entering a third charging time of a third charging period S32, T7 is switched from an off-state to an on-state to control the MLED to emit light; thereafter, T6 and T9 are turned on, C2 is charged with Vdatac3 until the voltage at the gate of T6 rises to Vdatac3+Vthc, where Vthc is the threshold voltage of T6, and T6 is turned off, the charging is stopped;

in the third light-emitting period S33, the EM is at a low level, and T4, T3, and T7 are all turned on to drive the MLED to emit light.

As can be seen from FIG. 10, in the second display phase S2 and the third display phase S3, the EM continues to input the low level, and the T4 is turned on, but not limited thereto.

When the pixel driving circuit shown in FIG. 9 of the present disclosure is in operation, the first integration time is determined by Vdatac1 and Vintc1, where Vintc1 is relatively low, Vintc1 is relatively high, the first integration time is relatively short, Vdatac1 is relatively large, the first integration time is relatively short, and Vdatac1 is relatively small, the first integration time is relatively long; the first integration time is long, and in the first display phase, the MLED emits light for a short time; the first integration time is short, and the MLED emits light for a long time in the first display period.

When the pixel driving circuit shown in FIG. 9 of the present disclosure is in operation, the second integration time is determined by Vdatac2 and Vintc2, where Vintc2 is relatively low, Vintc2 is relatively high, and then the second integration time is relatively short, where Vdatac2 is relatively high, and then the second integration time is relatively short, and where Vdatac2 is relatively low, then the second integration time is relatively long; the second integration time is long, and in the second display phase, the MLED emits light for a short time; the second integration time is short, and the MLED emits light for a long time in the second display period.

When the pixel driving circuit shown in FIG. 9 of the present disclosure is in operation, the third integration time is determined by Vdatac3 and Vintc3, where Vintc3 is relatively low, Vintc3 is relatively high, and then the third integration time is relatively short, where Vdatac3 is relatively high, and then the third integration time is relatively short, and where Vdatac3 is relatively low, then the third integration time is relatively long; the third integration time is long, and in the third display phase, the MLED light-emitting time is short; the third integration time is short, and the MLED emits light for a long time in the third display phase.

According to the timing diagram of operation shown in FIG. 10, Vdatac1, Vdatac2 and Vdatac3 are equal and Vintc1, Vintc2 and Vintc3 may not be equal.

Figure 12:
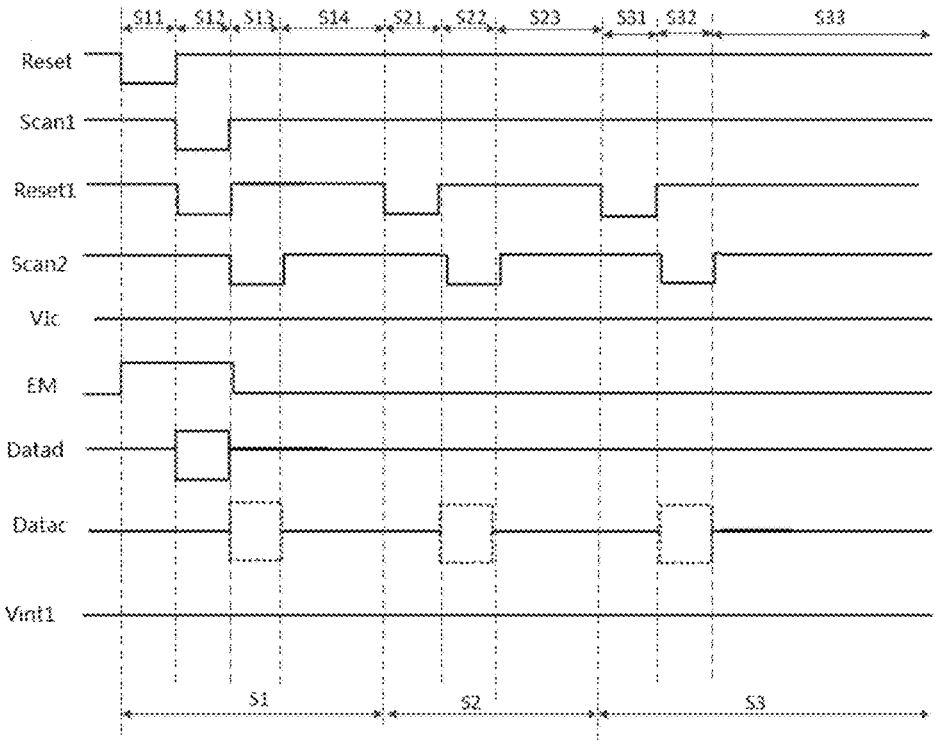
FIG. 12 is another operation timing diagram of the pixel driving circuit shown in FIG. 9 in the present disclosure.

FIG. 12 is another operation timing diagram of the pixel driving circuit shown in FIG. 9 in the present disclosure; unlike FIG. 10, Vdatac1, Vdatac2 and Vdatac3 are not equal, and Vintc1, Vintc2 and Vintc3 are equal, according to the operation timing chart shown in FIG. 12.

The pixel driving method according to the embodiment of the present disclosure is applied to the pixel driving circuit, and a display period includes a first display phase including a first data writing period, a first charging period and a first light-emitting period which are set sequentially, the pixel driving method includes:

in the first data writing period, the control initial voltage end inputting a first control initial voltage, and the light-emitting duration control circuit, in response to a first reset signal input by the first reset end, switching off a connection between the second end of the driving circuit and the light-emitting element, according to the first control initial voltage;

in the first charging period, the control data line inputting a first control data voltage, and the driving circuit, under a control of a voltage of the control end of the driving circuit, controlling the first end of the driving circuit and the second end of the driving circuit to connect to each other; the light-emitting duration control circuit, in response to a control scanning signal input by the control scanning line, according to the first control initial voltage and a first control data voltage, switching on the connection between the second end of the driving circuit and the light-emitting element after entering a first charging time of the first charging period, to control the light-emitting element to emit light;

in the first light-emitting period, the driving circuit, under the control of the voltage of the control end of the driving circuit, switching on the connection between the first end of the driving circuit and the second end of the driving circuit, and the light-emitting duration control circuit switching on the connection between the second end of the driving circuit and the light-emitting element, to control the light-emitting element to emit light.

According to the pixel driving method in the embodiment of the present disclosure, the connection time of the second end of the driving circuit 11 and the light-emitting element EL is controlled by the light-emitting duration control circuit, so that the light-emitting duration of the light-emitting element is controlled, and different gray level display are realized.

Specifically, the light-emitting duration control circuit includes a driving control sub-circuit, a driving control reset sub-circuit and a switching-on control sub-circuit;

the light-emitting duration control circuit, in response to the first reset signal input by the first reset end, switching off the connection between the second end of the driving circuit and the light-emitting element, according to the first control initial voltage, includes: the driving control reset sub-circuit, in response to the first reset signal, writing the first control initial voltage into a control end of the driving control sub-circuit, to enable the driving control sub-circuit to switch off the connection between the second end of the driving circuit and the light-emitting element under a control of a voltage of the control end of the driving control sub-circuit;

the light-emitting duration control circuit, in response to the control scanning signal input by the control scanning line, according to the first control initial voltage and the first control data voltage, switching on the connection between the second end of the driving circuit and the light-emitting element after entering the first charging time of the first charging period, includes:

the driving control sub-circuit switching off the connection between the second end of the driving circuit and the light-emitting element under the control of the voltage of the control end of the driving control sub-circuit; the switching-on control sub-circuit, in response to the control scanning signal, charging the control end of the driving control sub-circuit with the first control data voltage, to enable the driving control sub-circuit to switch on the connection between the second end of the driving circuit and the light-emitting element under the control of the voltage of the control end of the driving control sub-circuit after entering the first charging time of the first charging period;

the light-emitting duration control circuit switching on the connection between the second end of the driving circuit and the light-emitting element includes:

the driving control sub-circuit switching on the connection between the second end of the driving circuit and the light-emitting element under the control of the voltage of the control end of the driving control sub-circuit.

In some embodiments of the present disclosure, the light-emitting control duration control circuit may include a driving control sub-circuit, a driving control reset sub-circuit and a switching-on control sub-circuit, the driving control reset sub-circuit resets a voltage of the control end of the driving control sub-circuit to a first control initial voltage in a first data writing period, the switching-on control sub-circuit charges the control end of the driving control sub-circuit with a first control data voltage in a first charging period, so that the driving control sub-circuit switches on the connection between the second end of the driving circuit and the light-emitting element under the control of the voltage of the control end thereof after entering the first charging time of the first charging period, the first charging time can be controlled by adjusting the first control initial voltage and/or the first control data voltage, and the light-emitting time of the light-emitting element can be adjusted.

Specifically, the pixel driving circuit further includes a voltage maintaining circuit and a data writing circuit, the pixel driving method further includes:

in the first data writing period, the data writing circuit, in response to a display scanning signal input by a display scanning line, controlling the voltage of the control end of the driving circuit according to a display data voltage; the voltage maintaining circuit maintaining the voltage of the control end of the driving circuit.

In some embodiments of the present disclosure, the data writing circuit, in response to the display scanning signal input by the display scanning line, controlling the voltage of the control end of the driving circuit according to the display data voltage in the first data writing period, includes:

in the first data writing period, the data writing circuit, in response to the display scanning signal, writing the display data voltage Vdata1 into the first end of the driving circuit, and switching on the connection between the control end of the driving circuit and the second end of the driving circuit; the driving circuit switching on the connection between the first end of the driving circuit and the second end of the driving circuit under the control of the voltage of the control end of the driving circuit, to charge the control end of the driving circuit with the display data voltage Vdata1 until the driving circuit switches off the connection between the first end of the driving circuit and the second end of the driving circuit under the control of the voltage of the control end of the driving circuit, so that threshold voltage compensation is performed.

In some embodiments of the present disclosure, the pixel driving circuit further includes a reset circuit, and the first display phase further includes a setting period prior to the first data writing period, and the pixel driving method further includes:

in the setting period, the reset circuit, in response to a second reset signal input by a second reset end, writing a display initial voltage into the control end of the driving circuit, to enable the driving circuit to control the first end and the second end of the driving circuit to connect to each other under the control of the voltage of the control end of the driving circuit, and the voltage of the control end of the driving circuit is reset.

Specifically, the pixel driving circuit may further include a light-emitting control circuit; the pixel driving method further includes:

in the first data writing period, the light-emitting control circuit, in response to a light-emitting control signal input by a light-emitting control line, switching off a connection between the first end of the driving circuit and the first voltage end;

in the first charging period and the first light-emitting period, the light-emitting control circuit, in response to the light-emitting control signal, controlling the first end of the driving circuit and the first voltage end to connect to each other.

Optionally, the display period further includes at least one display phase subsequent to the first display period; an $n^{th}$ display phase includes an $n^{th}$ data writing period, an $n^{th}$ charging period and an $n^{th}$ light-emitting period; n is an integer greater than 1; the pixel driving method further includes:

in the $n^{th}$ data writing period, the control initial voltage end inputting an $n^{th}$ control initial voltage, and the light-emitting duration control circuit, in response to the first reset signal input by the first reset end, switching off the connection between the second end of the driving circuit and the light-emitting element, according to the $n^{th}$ control initial voltage;

in the $n^{th}$ charging period, the control data line inputting an $n^{th}$ control data voltage, and the driving circuit, under the control of the voltage of the control end of the driving circuit, controlling the first end of the driving circuit and the second end of the driving circuit to connect to each other; the light-emitting duration control circuit, in response to the control scanning signal input by the control scanning line, according to the $n^{th}$ control initial voltage and an $n^{th}$ control data voltage, switching on the connection between the second end of the driving circuit and the light-emitting element after entering an $n^{th}$ charging time of the $n^{th}$ charging period, to control the light-emitting element to emit light;

in the $n^{th}$ light-emitting period, the driving circuit, under the control of the voltage of the control end of the driving circuit, switching on the connection between the first end of the driving circuit and the second end of the driving circuit, and the light-emitting duration control circuit switching on the connection between the second end of the driving circuit and the light-emitting element, to control the light-emitting element to emit light.

In the embodiment of the present disclosure, a display period (i.e., a frame display time) is divided into n display phases (n is an integer greater than 1), and in each display phase, a light-emitting time of a light-emitting element is determined by a corresponding control data voltage and a corresponding control initial voltage, so as to increase the number of gray levels.

In some embodiments of the present disclosure, the light-emitting duration control circuit includes a driving control sub-circuit, a driving control reset sub-circuit and a switching-on control sub-circuit;

the light-emitting duration control circuit, in response to the first reset signal input by the first reset end, switching off the connection between the second end of the driving circuit and the light-emitting element, according to the $n^{th}$ control initial voltage, includes: the driving control reset sub-circuit, in response to the first reset signal, writing the $n^{th}$ control initial voltage into the control end of the driving control sub-circuit, to enable the driving control sub-circuit to switch off the connection between the second end of the driving circuit and the light-emitting element under the control of the voltage of the control end of the driving control sub-circuit;

the light-emitting duration control circuit, in response to the control scanning signal input by the control scanning line, according to the $n^{th}$ control initial voltage and the $n^{th}$ control data voltage, switching on the connection between the second end of the driving circuit and the light-emitting element after entering the $n^{th}$ charging time of the $n^{th}$ charging period, includes:

the driving control sub-circuit switching off the connection between the second end of the driving circuit and the light-emitting element under the control of the voltage of the control end of the driving control sub-circuit; the switching-on control sub-circuit, in response to the control scanning signal, charging the control end of the driving control sub-circuit with the $n^{th}$ control data voltage, to enable the driving control sub-circuit to switch on the connection between the second end of the driving circuit and the light-emitting element under the control of the voltage of the control end of the driving control sub-circuit after entering the $n^{th}$ charging time of the $n^{th}$ charging period.

In some embodiments of the present disclosure, the light-emitting control duration control circuit may include a driving control sub-circuit, a driving control reset sub-circuit, and a switching-on control sub-circuit, the driving control reset sub-circuit resets a voltage of the control end of the driving control sub-circuit to an $n^{th}$ control initial voltage in an $n^{th}$ data writing period, the switching-on control sub-circuit charges the control end of the driving control sub-circuit with an $n^{th}$ control data voltage in an $n^{th}$ charging period, so that after entering the $n^{th}$ charging time of the $n^{th}$ charging period, the driving control sub-circuit switches on the connection between the second end of the driving circuit and the light-emitting element under the control of the voltage of the control end of the driving control sub-circuit. By modulating the $n^{th}$ control initial voltage and/or the $n^{th}$ control data voltage, the $n^{th}$ charging time can be controlled, and the light-emitting time of the light-emitting element can be adjusted.

Specifically, the $n^{th}$ control data voltage is equal to the first control data voltage; alternatively, the $n^{th}$ control initial voltage is equal to the first control initial voltage.

Specifically, when the pixel driving circuit includes a light-emitting control circuit, the pixel driving method further includes: in the $n^{th}$ display phase, the light-emitting control circuit enables the first end of the driving circuit and the first voltage end to connect to each other under the control of the light-emitting control signal.

The display device in the embodiment of the present disclosure includes the pixel driving circuit.

When the display device is manufactured, the driving backboard is manufactured by adopting a glass-based LTPS (Low Temperature Poly-silicon) process, the micro light-emitting diode is arranged on the driving backboard by adopting a transfer printing mode in the embodiment of the disclosure, the pad for welding the anode of the micro light-emitting diode and the cathode of the micro light-emitting diode is arranged on the driving backboard, the structure of vertically laminating the cathode and the anode before the modification is similar to the structure of manufacturing a socket on the driving backboard, and then the micro light-emitting diode is directly transferred to the driving backboard, and finally the whole display module is manufactured.

Figure 13:
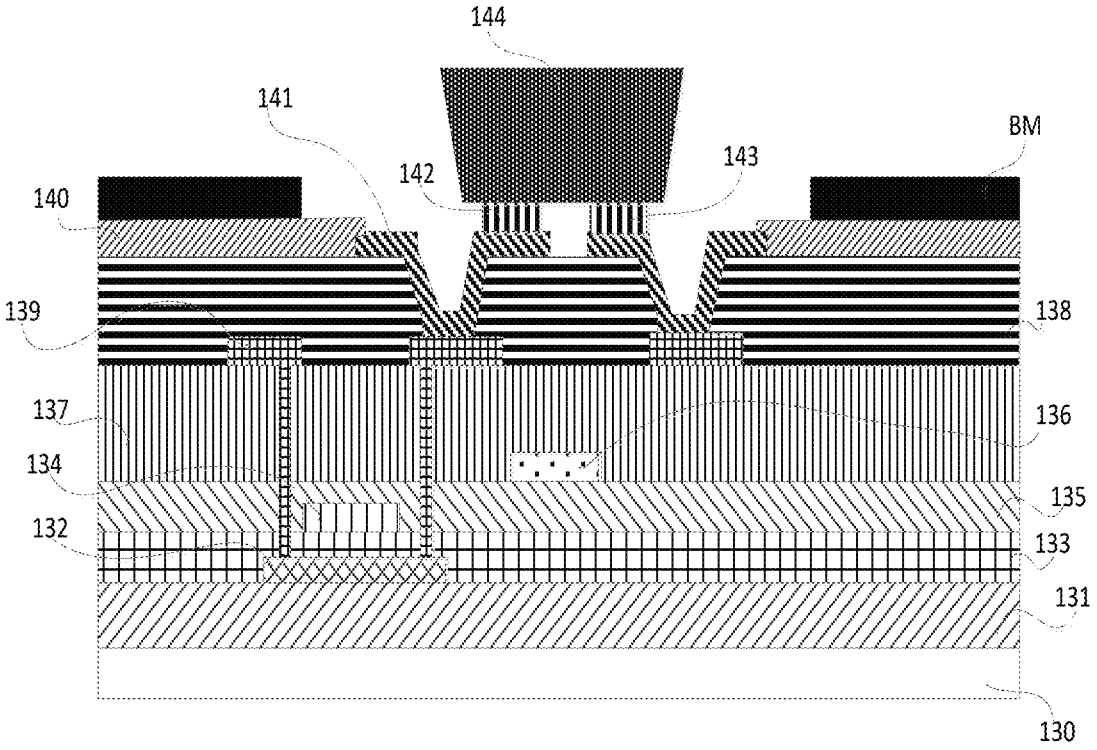
FIG. 13 is a structural view of a driving back plate in a display device in an embodiment of the disclosure.

FIG. 13 is a structural view of a driving back plate in a display device in an embodiment of the disclosure.

In FIG. 13, reference numeral 130 is a glass substrate, reference numeral 131 is a buffer layer, reference numeral 132 is an active layer, reference numeral 133 is a first gate insulating layer, reference numeral 134 is a first gate metal layer, reference numeral 135 is a second gate metal layer, reference numeral 136 is a second gate metal layer, reference numeral 137 is an interlayer dielectric layer, reference numeral 138 is a planarization layer, reference numeral 139 is a source-drain metal layer, reference numeral 140 is a passivation layer, reference numeral 141 is a pad, reference numeral 142 is an anode of a micro light-emitting diode, reference numeral 143 is a cathode of the micro light-emitting diode, and reference numeral 144 is a micro light-emitting diode.

The display device provided by the embodiment of the disclosure may be any product or component with a display function, such as a mobile phone, a tablet computer, a television, a display, a notebook computer, a digital photo frame, a navigator and the like.

The foregoing is directed to embodiments of the present disclosure, it will be appreciated by those skilled in the art that various changes and modifications may be made without departing from the principle of the disclosure, and it is intended that such changes and modifications be considered as within the scope of the disclosure.

What is claimed is:

1. A pixel driving circuit, applied to drive a light-emitting element, wherein the pixel driving circuit comprises a driving circuit and a light-emitting duration control circuit, wherein a first end of the driving circuit is connected to a first voltage end, a second end of the driving circuit is connected to the light-emitting element via the light-emitting duration control circuit, and the driving circuit is configured to, under a control of a voltage of a control end of the driving circuit, control the first end and the second end to connect to each other, wherein the light-emitting duration control circuit is configured to, in response to a first reset signal input by a first reset end and a control scanning signal input by a control scanning line, switch on or switch off a connection between the second end of the driving circuit and the light-emitting element, according to a control data voltage input by a control data line and a control initial voltage input by a control initial voltage end, to control a light-emitting period of the light-emitting element, wherein the light-emitting duration control circuit comprises a driving control sub-circuit, a driving control reset sub-circuit and a switching-on control sub-circuit, wherein a first end of the driving control sub-circuit is connected to the second end of the driving circuit, and a second end of the driving control sub-circuit is connected to the light-emitting element, wherein the driving control reset sub-circuit is configured to, in response to the first reset signal input by the first reset end, write the control initial voltage into a control end of the driving control sub-circuit, to enable the driving control sub-circuit to switch off the connection between the second end of the driving circuit and the light-emitting element under a control of a voltage of the control end of the driving control sub-circuit, and wherein the switching-on control sub-circuit is configured to, in response to the control scanning signal, charge the control end of the driving control sub-circuit with the control data voltage, to enable the driving control sub-circuit to switch on the connection between the second end of the driving circuit and the light-emitting element under a control of a voltage of the control end of the driving control sub-circuit.

2. The pixel driving circuit according to claim 1, wherein the switching-on control sub-circuit comprises a first switching-on control transistor, a second switching-on control transistor and a switching-on control capacitor;

a control electrode of the first switching-on control transistor is connected to the control end of the driving control sub-circuit, a first electrode of the first switching-on control transistor is connected to a first electrode of the second switching-on control transistor, and a second electrode of the first switching-on control transistor is connected to the control data line;

a control electrode of the second switching-on control transistor is connected to the control scanning line, and a second electrode of the second switching-on control transistor is connected to the control end of the driving control sub-circuit; and a first end of the switching-on control capacitor is connected to the control end of the driving control sub-circuit, and a second end of the switching-on control capacitor is connected to a second voltage end.

3. The pixel driving circuit according to claim 1, wherein the driving control reset sub-circuit comprises a driving control reset transistor;

a control electrode of the driving control reset transistor is connected to the first reset end, a first electrode of the driving control reset transistor is connected to the control end of the driving control sub-circuit, and a second electrode of the driving control reset transistor is connected to the control initial voltage end; the control initial voltage end is configured to input the control initial voltage.

4. The pixel driving circuit according to claim 1, wherein the driving control sub-circuit comprises a driving control transistor;

a control electrode of the driving control transistor is the control end of the driving control sub-circuit, a first electrode of the driving control transistor is the first end of the driving control sub-circuit, and a second electrode of the driving control transistor is the second end of the driving control sub-circuit.

5. The pixel driving circuit according to claim 1, further comprising a reset circuit, wherein the reset circuit is configured to, in response to a second reset signal input by a second reset end, write a display initial voltage into the control end of the driving circuit, to enable the driving circuit to control the first end and the second end of the driving circuit to connect to each other under the control of the voltage of the control end of the driving circuit.

6. The pixel driving circuit according to claim 1, further comprising a voltage maintaining circuit and a data writing circuit;

the voltage maintaining circuit is connected to the control end of the driving circuit and configured to maintain a voltage of the control end of the driving circuit;

the data writing circuit is configured to, in response to a display scanning signal input by a display scanning line, control the voltage of the control end of the driving circuit according to a display data voltage input by a display data line.

7. The pixel driving circuit according to claim 6, wherein the data writing circuit comprises a data writing sub-circuit and a compensation control sub-circuit, wherein the data writing sub-circuit is configured to, in response to the display scanning signal, write the display data voltage into the first end of the driving circuit;

the compensation control sub-circuit is configured to, in response to the display scanning signal, control the control end of the driving circuit and the second end of the driving circuit to connect to each other.

8. The pixel driving circuit according to claim 7, wherein the data writing sub-circuit comprises a data writing transistor, the compensation control sub-circuit comprises a compensation control transistor, wherein a control electrode of the data writing transistor is connected to the display scanning line, a first electrode of the data writing transistor is connected to the display data line, and a second electrode of the data writing transistor is connected to the first end of the driving circuit;

a control electrode of the compensation control transistor is connected to the display scanning line, a first electrode of the compensation control transistor is connected to the control end of the driving circuit, and a second electrode of the compensation control transistor is connected to the second end of the driving circuit.

9. The pixel driving circuit according to claim 6, wherein the voltage maintaining circuit comprises a storage capacitor, and a first end of the storage capacitor is connected to the control end of the driving circuit, and a second end of the storage capacitor is connected to a third voltage end.

10. The pixel driving circuit according to claim 1, further comprising a light-emitting control circuit;

the first end of the driving circuit is connected to the first voltage end via the light-emitting control circuit;

a control end of the light-emitting control circuit is connected to a light-emitting control line, and the light-emitting control circuit is configured to, in response to a light-emitting control signal input by the light-emitting control line, control the first end of the driving circuit and the first voltage end to connect to each other.

11. The pixel driving circuit according to claim 1, wherein the driving circuit comprises a driving transistor;

a control electrode of the driving transistor is the control end of the driving circuit, a first electrode of the driving transistor is the first end of the driving circuit, and a second electrode of the driving transistor is the second end of the driving circuit.

12. A pixel driving method, applied to a pixel driving circuit, wherein the pixel driving circuit is applied to drive a light-emitting element, the pixel driving circuit comprises a driving circuit and a light-emitting duration control circuit, wherein a first end of the driving circuit is connected to a first voltage end, a second end of the driving circuit is connected to the light-emitting element via the light-emitting duration control circuit, and the driving circuit is configured to, under a control of a voltage of a control end of the driving circuit, control the first end and the second end to connect to each other, wherein the light-emitting duration control circuit is configured to, in response to a first reset signal input by a first reset end and a control scanning signal input by a control scanning line, switch on or switch off a connection between the second end of the driving circuit and the light-emitting element, according to a control data voltage input by a control data line and a control initial voltage input by a control initial voltage end, to control a light-emitting period of the light-emitting element, wherein a display period comprises a first display phase comprising a first data writing period, a first charging period and a first light-emitting period which are set sequentially, the pixel driving method comprises:

in the first data writing period, the control initial voltage end inputting a first control initial voltage, and the light-emitting duration control circuit, in response to a first reset signal input by the first reset end, switching off a connection between the second end of the driving circuit and the light-emitting element, according to the first control initial voltage;

in the first charging period, the control data line inputting a first control data voltage, and the driving circuit, under a control of a voltage of the control end of the driving circuit, controlling the first end of the driving circuit and the second end of the driving circuit to connect to each other; the light-emitting duration control circuit, in response to a control scanning signal input by the control scanning line, according to the first control initial voltage and a first control data voltage, switching on the connection between the second end of the driving circuit and the light-emitting element after entering a first charging time of the first charging period, to control the light-emitting element to emit light; and in the first light-emitting period, the driving circuit, under the control of the voltage of the control end of the driving circuit, switching on the connection between the first end of the driving circuit and the second end of the driving circuit, and the light-emitting duration control circuit switching on the connection between the second end of the driving circuit and the light-emitting element, to control the light-emitting element to emit light.

13. The pixel driving method according to claim 12, wherein the light-emitting duration control circuit comprises a driving control sub-circuit, a driving control reset sub-circuit and a switching-on control sub-circuit;

the light-emitting duration control circuit, in response to the first reset signal input by the first reset end, switching off the connection between the second end of the driving circuit and the light-emitting element, according to the first control initial voltage, comprises: the driving control reset sub-circuit, in response to the first reset signal, writing the first control initial voltage into a control end of the driving control sub-circuit, to enable the driving control sub-circuit to switch off the connection between the second end of the driving circuit and the light-emitting element under a control of a voltage of the control end of the driving control sub-circuit;

the light-emitting duration control circuit, in response to the control scanning signal input by the control scanning line, according to the first control initial voltage and the first control data voltage, switching on the connection between the second end of the driving circuit and the light-emitting element after entering the first charging time of the first charging period, comprises:

the driving control sub-circuit switching off the connection between the second end of the driving circuit and the light-emitting element under the control of the voltage of the control end of the driving control sub-circuit; the switching-on control sub-circuit, in response to the control scanning signal, charging the control end of the driving control sub-circuit with the first control data voltage, to enable the driving control sub-circuit to switch on the connection between the second end of the driving circuit and the light-emitting element under the control of the voltage of the control end of the driving control sub-circuit after entering the first charging time of the first charging period;

the light-emitting duration control circuit switching on the connection between the second end of the driving circuit and the light-emitting element comprises:

the driving control sub-circuit switching on the connection between the second end of the driving circuit and the light-emitting element under the control of the voltage of the control end of the driving control sub-circuit.

14. The pixel driving method according to claim 12, wherein the pixel driving circuit further comprises a voltage maintaining circuit and a data writing circuit, the pixel driving method further comprises:

in the first data writing period, the data writing circuit, in response to a display scanning signal input by a display scanning line, controlling the voltage of the control end of the driving circuit according to a display data voltage; the voltage maintaining circuit maintaining the voltage of the control end of the driving circuit.

15. The pixel driving method according to claim 14, wherein the data writing circuit, in response to the display scanning signal input by the display scanning line, controlling the voltage of the control end of the driving circuit according to the display data voltage in the first data writing period, comprises:

in the first data writing period, the data writing circuit, in response to the display scanning signal, writing the display data voltage Vdata1 into the first end of the driving circuit, and switching on the connection between the control end of the driving circuit and the second end of the driving circuit; the driving circuit switching on the connection between the first end of the driving circuit and the second end of the driving circuit under the control of the voltage of the control end of the driving circuit, to charge the control end of the driving circuit with the display data voltage Vdata1 until the driving circuit switches off the connection between the first end of the driving circuit and the second end of the driving circuit under the control of the voltage of the control end of the driving circuit.

16. The pixel driving method according to claim 15, wherein the pixel driving circuit further comprises a reset circuit, and the first display phase further comprises a setting period prior to the first data writing period, and the pixel driving method further comprises:

in the setting period, the reset circuit, in response to a second reset signal input by a second reset end, writing a display initial voltage into the control end of the driving circuit, to enable the driving circuit to control the first end and the second end of the driving circuit to connect to each other under the control of the voltage of the control end of the driving circuit.

17. The pixel driving method according to claim 12, wherein the pixel driving circuit further comprises a light-emitting control circuit, the pixel driving method further comprises:

in the first data writing period, the light-emitting control circuit, in response to a light-emitting control signal input by a light-emitting control line, switching off a connection between the first end of the driving circuit and the first voltage end;

in the first charging period and the first light-emitting period, the light-emitting control circuit, in response to the light-emitting control signal, controlling the first end of the driving circuit and the first voltage end to connect to each other.

18. The pixel driving method according to claim 12, wherein the display period further comprises at least one display phase subsequent to the first display period; an $n^{th}$ display phase comprises an $n^{th}$ data writing period, an $n^{th}$ charging period and an $n^{th}$ light-emitting period; n is an integer greater than 1; the pixel driving method further comprises:

in the $n^{th}$ data writing period, the control initial voltage end inputting an $n^{th}$ control initial voltage, and the light-emitting duration control circuit, in response to the first reset signal input by the first reset end, switching off the connection between the second end of the driving circuit and the light-emitting element, according to the $n^{th}$ control initial voltage;

in the $n^{th}$ charging period, the control data line inputting an $n^{th}$ control data voltage, and the driving circuit, under the control of the voltage of the control end of the driving circuit, controlling the first end of the driving circuit and the second end of the driving circuit to connect to each other; the light-emitting duration control circuit, in response to the control scanning signal input by the control scanning line, according to the $n^{th}$ control initial voltage and an $n^{th}$ control data voltage, switching on the connection between the second end of the driving circuit and the light-emitting element after entering an $n^{th}$ charging time of the $n^{th}$ charging period, to control the light-emitting element to emit light;

in the $n^{th}$ light-emitting period, the driving circuit, under the control of the voltage of the control end of the driving circuit, switching on the connection between the first end of the driving circuit and the second end of the driving circuit, and the light-emitting duration control circuit switching on the connection between the second end of the driving circuit and the light-emitting element, to control the light-emitting element to emit light.

19. The pixel driving method according to claim 18, wherein the light-emitting duration control circuit comprises a driving control sub-circuit, a driving control reset sub-circuit and a switching-on control sub-circuit;

the light-emitting duration control circuit, in response to the first reset signal input by the first reset end, switching off the connection between the second end of the driving circuit and the light-emitting element, according to the $n^{th}$ control initial voltage, comprises: the driving control reset sub-circuit, in response to the first reset signal, writing the $n^{th}$ control initial voltage into the control end of the driving control sub-circuit, to enable the driving control sub-circuit to switch off the connection between the second end of the driving circuit and the light-emitting element under the control of the voltage of the control end of the driving control sub-circuit;

the light-emitting duration control circuit, in response to the control scanning signal input by the control scanning line, according to the $n^{th}$ control initial voltage and the $n^{th}$ control data voltage, switching on the connection between the second end of the driving circuit and the light-emitting element after entering the $n^{th}$ charging time of the $n^{th}$ charging period, comprises:

the driving control sub-circuit switching off the connection between the second end of the driving circuit and the light-emitting element under the control of the voltage of the control end of the driving control sub-circuit; the switching-on control sub-circuit, in response to the control scanning signal, charging the control end of the driving control sub-circuit with the $n^{th}$ control data voltage, to enable the driving control sub-circuit to switch on the connection between the second end of the driving circuit and the light-emitting element under the control of the voltage of the control end of the driving control sub-circuit after entering the $n^{th}$ charging time of the $n^{th}$ charging period;

or the $n^{th}$ control data voltage is equal to the first control data voltage; or the $n^{th}$ control initial voltage is equal to the first control initial voltage.

* * * * *